US009207628B2

(12) United States Patent
Hoshino et al.

(10) Patent No.: US 9,207,628 B2
(45) Date of Patent: Dec. 8, 2015

(54) IMAGE FORMING APPARATUS PROVIDED WITH STRUCTURE FOR RECEIVING LIQUID

(71) Applicant: Brother Kogyo Kabushiki Kaisha, Nagoya-shi, Aichi-ken (JP)

(72) Inventors: Takashi Hoshino, Nagoya (JP); Yuji Takenoshita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/538,199

(22) Filed: Nov. 11, 2014

(65) Prior Publication Data

US 2015/0139685 A1 May 21, 2015

(30) Foreign Application Priority Data

Nov. 15, 2013 (JP) ..... 2013-236865
Nov. 15, 2013 (JP) ..... 2013-236866

(51) Int. Cl.
*G03G 15/00* (2006.01)
*G03G 21/16* (2006.01)

(52) U.S. Cl.
CPC ..... *G03G 21/1619* (2013.01); *G03G 15/80* (2013.01)

(58) Field of Classification Search
CPC ..... G03G 21/1619
See application file for complete search history.

(56) References Cited

U.S. PATENT DOCUMENTS 7,484,722 B2 2/2009 Ishii
7,748,706 B2 7/2010 Ishii
7,995,948 B2 8/2011 Yano et al.
8,155,556 B2 4/2012 Moribe et al.
8,204,401 B2 6/2012 Tsuchiya
2006/0008294 A1 1/2006 Ito et al.
2006/0269320 A1 11/2006 Ishii (Continued)

FOREIGN PATENT DOCUMENTS

JP H03-217861 A 9/1991
JP 2002-137493 A 5/2002

(Continued)

OTHER PUBLICATIONS

Apr. 10, 2015—(US) Non-Final Office Action—U.S. Appl. No. 14/538,304.

(Continued)

*Primary Examiner* — David Gray
*Assistant Examiner* — Michael Harrison
(74) *Attorney, Agent, or Firm* — Banner & Witcoff, Ltd.

(57) ABSTRACT

An image forming apparatus includes a casing, an image-forming unit, a circuit board for controlling operations of the image-forming unit, a receiving unit for receiving liquid entering into the casing. The casing includes: a wall portion constituting a top surface and positioned upward of the image-forming unit; a first frame supporting the circuit board; and a second frame opposing the first frame in an orthogonal direction orthogonal to a vertical direction. The wall portion includes a first member and a second member positioned adjacent to each other to provide a first gap therebetween. The image-forming unit is disposed between the first frame and the second frame. The receiving unit is positioned below the first gap and includes a receiving wall for receiving the liquid entering into the casing through the first gap, the receiving wall being slanted downward toward the second frame.

20 Claims, 10 Drawing Sheets

(56) References Cited

U.S. PATENT DOCUMENTS

| | | | | |
|---|---|---|---|---|
| 2007/0002290 | A1 | 1/2007 | Muraki et al. | |
| 2007/0036604 | A1 | 2/2007 | Maekawa et al. | |
| 2008/0049260 | A1 | 2/2008 | Moribe et al. | |
| 2009/0116889 | A1 | 5/2009 | Ishii | |
| 2012/0251201 | A1* | 10/2012 | Ukai ..... | G03G 15/2003 399/322 |
| 2013/0272744 | A1 | 10/2013 | Wakayama et al. | |

FOREIGN PATENT DOCUMENTS

| | | | |
|---|---|---|---|
| JP | 2002-182441 | A | 6/2002 |
| JP | 2002-351282 | A | 12/2002 |
| JP | 2005-018011 | A | 1/2005 |
| JP | 2006-053508 | A | 2/2006 |
| JP | 2006-337570 | A | 12/2006 |
| JP | 2007-062159 | A | 3/2007 |
| JP | 2007-292968 | A | 11/2007 |
| JP | 2008-052037 | A | 3/2008 |
| JP | 2009-169120 | A | 7/2009 |
| JP | 2009-169126 | A | 7/2009 |
| JP | 4826387 | B2 | 11/2011 |
| JP | 2012-203989 | A | 10/2012 |

OTHER PUBLICATIONS

May 22, 2015—(US) Notice of Allowance—U.S. Appl. No. 14/547,608.

Jun. 11, 2015—(US) Notice of Allowance—U.S. Appl. No. 14/525,608.

Jun. 23, 2015—(US) Notice of Allowance—U.S. Appl. No. 14/553,116.

* cited by examiner

IMAGE FORMING APPARATUS PROVIDED WITH STRUCTURE FOR RECEIVING LIQUID

CROSS REFERENCE TO RELATED APPLICATION

This application claims priorities from Japanese Patent Application Nos. 2013-236866 filed Nov. 15, 2013 and 2013-236865 filed Nov. 15, 2013. The entire contents of these priority applications are incorporated herein by reference.

TECHNICAL FIELD

The present invention relates to an image forming apparatus employing an electrophotographic system.

BACKGROUND

One electrophotographic image forming apparatus known in the art is a laser printer provided with a body case; and, disposed in the body case, a process cartridge that forms toner images on recording paper, and a fixing unit that fixes the toner images formed on the recording paper (for example, see Japanese Patent Application Publication No. 2006-53508).

SUMMARY

The above-described laser printer is also provided with a circuit board for controlling operations of the process cartridge and fixing unit. Thus if a user of the conventional laser printer described above accidentally spills a liquid onto the top of the printer, the spilled liquid may penetrate and flow into the body case through seams or junctures therein.

If the spilled liquid flows into the body case of the laser printer, the circuit board may become wet, resulting in electrical short-circuits. Likewise, if the liquid penetrates the body case of the laser printer, the process cartridge, fixing unit, and the like may also become wet, resulting in malfunctions, such as electrical short-circuits.

In view of the foregoing, it is an object of the present invention to provide an image forming apparatus capable of preventing a circuit board, an image-forming unit and other components in the image forming apparatus from becoming wet when liquid is spilled onto a wall or a cover constituting of the body case of the apparatus.

In order to attain the above and other objects, there is provided an image forming apparatus that may include: a casing; an image-forming unit disposed within the casing and configured to form an image on a recording medium; a circuit board configured to control operations of the image-forming unit; and a receiving unit configured to receive liquid entering into the casing. The casing includes a wall portion, a first frame and a second frame. The wall portion constitutes a top surface of the casing and is positioned upward of the image-forming unit in a vertical direction, the wall portion including a first member and a second member positioned adjacent to each other to provide a first gap therebetween. The first frame supports the circuit board. The second frame is disposed to oppose and is spaced away from the first frame in an orthogonal direction orthogonal to the vertical direction, the image-forming unit being disposed between the first frame and the second frame in the orthogonal direction. The receiving unit is positioned below the first gap, the receiving unit including a receiving wall configured to receive the liquid entering into the casing through the first gap, the receiving wall being slanted downward toward the second frame.

DETAILED DESCRIPTION

1. Overall Structure of a Printer

Figure 1:
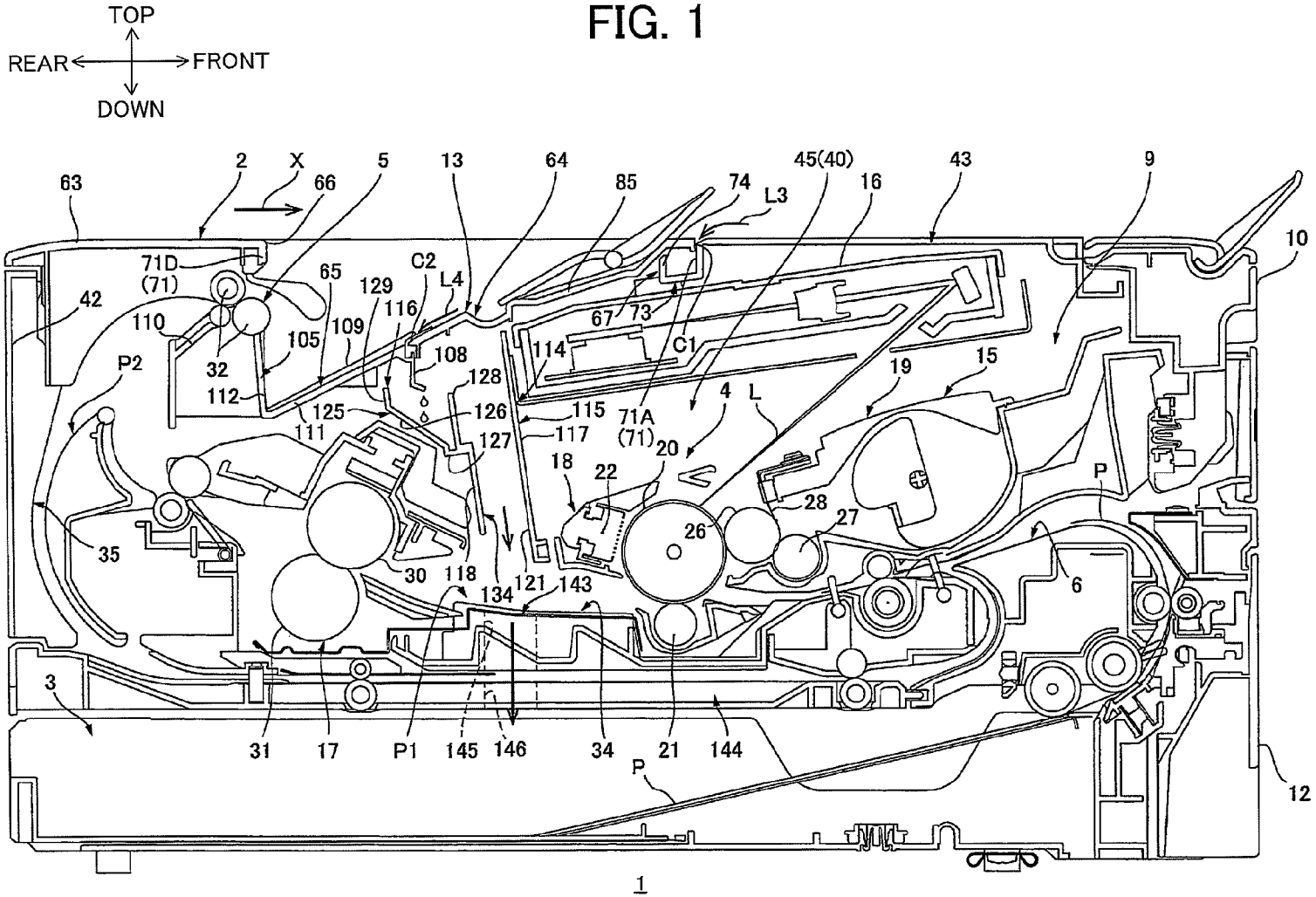
FIG. 1 is a central cross-sectional view illustrating a general configuration of a printer as an example of an image forming apparatus according to an embodiment of the present invention, the printer including an upper wall and a liquid-receiving unit.

A general configuration of a printer 1 as an example of an image forming apparatus according to an embodiment of the present invention will be described with reference to FIG. 1.

The printer 1 of the embodiment is a monochrome printer employing an electrophotographic system. As shown in FIG. 1, the printer 1 includes a box-like shaped main casing 2 as an example of a casing, a sheet-feeding unit 3, an image-forming unit 4, a sheet-discharging unit 5, and a conveyance-guiding unit 6.

The main casing 2 accommodates the sheet-feeding unit 3, image-forming unit 4, sheet-discharging unit 5, and conveyance-guiding unit 6.

Throughout the specification, the terms "above", "below", "right", "left", "front", "rear" and the like will be used assuming that the printer 1 is resting on a level surface. More specifically, in FIG. 1, a right side and a left side will be referred to as a front side and a rear side of the printer 1, respectively. Further, left and right sides of the printer 1 in the following description will be based on the perspective of a user facing the front side of the printer 1. Thus, a near side of the printer 1 in FIG. 1 will be considered a "left side," and a far side will be considered a "right side." Further, top and bottom of the printer 1 will be based on the vertical direction in FIG. 1. That is, a front-rear direction and a left-right direction are both horizontal, and a top-down direction is vertical. These directions are shown specifically in each drawing.

The top-down direction corresponds to a vertical direction and a left-right direction corresponds to an orthogonal direction. A direction from the rear side to the front side is an example of a discharge direction X. In other words, the orthogonal direction is a direction perpendicular to both the top-down direction (vertical direction) and discharge direction X.

The main casing 2 includes a cartridge-insertion opening 9, a front cover 10, and a discharge tray 13 as an example of a support tray.

The cartridge-insertion opening 9 is provided in a front end portion of the main casing 2 and penetrates a front wall of the main casing 2 in the front-rear direction. The front cover 10 is supported on the front wall of the main casing 2 and is capable of pivoting about its bottom edge portion. By pivoting, the front cover 10 can expose or cover the cartridge-insertion opening 9.

As will be described later in greater detail, the discharge tray 13 is disposed in a rear portion of a top wall 43 constituting the main casing 2. The discharge tray 13 is a downward depression in a top surface of the main casing 2 that serves to receive sheets P of paper, which is an example of a recording medium.

The sheet-feeding unit 3 is provided in a bottom portion of the main casing 2. The sheet-feeding unit 3 is configured to supply sheets P to the image-forming unit 4. The sheet-feeding unit 3 includes a paper tray 12. The paper tray 12 has a box-like shape and is open on the top for accommodating a plurality of sheets P in a stacked arrangement. The paper tray 12 can be mounted in and removed from the main casing 2.

The image-forming unit 4 is configured to form images on the sheets P. The image-forming unit 4 is provided in the main casing 2 above the sheet-feeding unit 3. The image-forming unit 4 includes a process cartridge 15 as an example of a process unit, a scanning unit 16, and a fixing unit 17.

The process cartridge 15 is configured to form toner images on the sheets P. The process cartridge 15 can be mounted in and removed from the main casing 2 through the cartridge-insertion opening 9. When mounted in the main casing 2, the process cartridge 15 is disposed in an approximate vertical center region of the main casing 2.

The process cartridge 15 includes a drum cartridge 18, and a developing cartridge 19.

The drum cartridge 18 includes a photosensitive drum 20, a transfer roller 21, and a scorotron charger 22. The photosensitive drum 20 is provided in a rear end portion of the drum cartridge 18. The transfer roller 21 is disposed below the photosensitive drum 20 such that the top surface of the transfer roller 21 contacts the bottom surface of the photosensitive drum 20. The scorotron charger 22 is disposed diagonally upward and rearward of the photosensitive drum 20 while being separated therefrom by a slight gap.

The developing cartridge 19 is configured to be mounted in and removed from the drum cartridge 18. When mounted in the drum cartridge 18, the developing cartridge 19 is positioned on the upper front side of the photosensitive drum 20.

The developing cartridge 19 includes a developing roller 26, a supply roller 27, and a thickness-regulating blade 28. The developing cartridge 19 also accommodates toner.

The developing roller 26 is disposed in a rear end portion of the developing cartridge 19 so that upper and rear portions of the developing roller 26 are exposed outside the developing cartridge 19. The developing roller 26 has a rear surface to be in contact with the photosensitive drum 20 at a front side thereof.

The supply roller 27 is disposed downward and frontward of the developing roller 26. The upper rear surface of the supply roller 27 contacts the lower front surface of the developing roller 26 with pressure. The thickness-regulating blade 28 has a plate shape that is elongated in the left-right and vertical directions. The bottom end portion of the thickness-regulating blade 28 contacts the upper front surface of the developing roller 26.

The scanning unit 16 is disposed in the main casing 2 above the process cartridge 15. As depicted with a solid line in FIG. 1, the scanning unit 16 irradiates a laser beam L based on image data toward the photosensitive drum 20, exposing a peripheral surface of the photosensitive drum 20.

The fixing unit 17 is disposed in the main casing 2 rearward of the process cartridge 15, with space formed therebetween.

The fixing unit 17 includes a heating roller 30, and a pressure roller 31. The heating roller 30 is positioned on the upper front side of the pressure roller 31. The lower rear surface of the heating roller 30 contacts the upper front surface of the pressure roller 31 with pressure.

The sheet-discharging unit 5 is disposed above and rearward of the fixing unit 17. The sheet-discharging unit 5 includes a pair of discharge rollers 32 as examples of a discharge member.

The discharge rollers 32 are arranged to the rear of the discharge tray 13. The discharge rollers 32 are generally columnar-shaped with their axes aligned in the left-right direction. One of the discharge rollers 32 is positioned on the upper rear side of the other and contacts the upper rear surface of the other with its lower front surface. The rotating direction of each discharge roller 32 can be switched between a forward rotation and a reverse rotation. When rotating forward, the discharge rollers 32 convey the sheets P onto the discharge tray 13. When rotating in reverse, the discharge rollers 32 convey the sheets P to a second conveyance guide 35 described later.

The conveyance-guiding unit 6 is configured to guide the sheets P being conveyed. The conveyance-guiding unit 6 includes a first conveyance guide 34, and the second conveyance guide 35.

The first conveyance guide 34 guides conveyance of a sheet P when an image is being formed on one surface (first surface) of the sheet P. Specifically, the first conveyance guide 34 guides the sheet P from the paper tray 12 such that the sheet P passes between the photosensitive drum 20 and transfer roller 21, and then between the heating roller 30 and pressure roller 31 to arrive at the discharge rollers 32. In this way, the first conveyance guide 34 defines a conveying path P1 having a general S-shape in a side view.

The second conveyance guide 35 guides conveyance of a sheet P when an image is being formed on the other surface (second surface) of the sheet P after an image has already been formed on the first surface. Specifically, the second conveyance guide 35 guides the sheet P from the discharge rollers 32 back to the front side of the photosensitive drum 20. In this way, the second conveyance guide 35 defines a re-conveying path P2 that has a general C-shape in a side view with the opening of the "C" facing upward.

The second conveyance guide 35 has a rear end connected to an upper end of the first conveyance guide 34 on the rear side of the discharge rollers 32. The second conveyance guide 35 has a front end connected to a midpoint of the first conveyance guide 34 in front of the photosensitive drum 20 and transfer roller 21.

When the printer 1 described above begins an image-forming operation under control of a control unit (not shown), the scorotron charger 22 applies a uniform charge to the surface of the photosensitive drum 20. Next, the scanning unit 16 exposes the surface of the photosensitive drum 20, forming an electrostatic latent image on the surface of the photosensitive drum 20 based on image data.

The supply roller 27 supplies toner to the developing roller 26. At this time, the toner is positively tribocharged between the developing roller 26 and supply roller 27 so that the developing roller 26 carries the charged toner. The thickness-regulating blade 28 regulates the toner carried on the surface of the developing roller 26 at a uniform thickness. The developing roller 26 then supplies the toner of uniform thickness to the latent image formed on the surface of the photosensitive drum 20. As a result, the photosensitive drum 20 carries a toner image on its surface.

In the meantime, various rollers in the printer 1 rotate to feed the sheets P from the paper tray 12 and to supply the sheets P one at a time and at a prescribed timing to the position between the photosensitive drum 20 and transfer roller 21 while the sheets P are guided by the first conveyance guide 34. As a sheet P passes between the photosensitive drum 20 and transfer roller 21, the toner image carried on the photosensitive drum 20 is transferred onto the first surface of the sheet P.

The sheet P is subsequently conveyed through the fixing unit 17 and toward the discharge rollers 32 while still being guided by the first conveyance guide 34. When passing through the fixing unit 17, the heating roller 30 and pressure roller 31 apply heat and pressure to the sheet P, thermally fixing the toner image to the sheet P. Subsequently, the discharge rollers 32 rotating in the forward rotation convey the sheet P in the discharge direction X (forward) and discharge the sheet P onto the discharge tray 13. Accordingly, the sheets P discharged from the main casing 2 are received on the discharge tray 13.

When forming an image on the second surface of a sheet P, i.e., when forming images on both surfaces of the sheet P, first an image is formed on the first surface of the sheet P, as described above. However, before the sheet P is discharged from the main casing 2, the discharge rollers 32 are rotated in reverse to convey the sheet P to the second conveyance guide 35. At this time, the sheet P is guided by the second conveyance guide 35 and returned to the midpoint of the first conveyance guide 34 in front of the photosensitive drum 20 and transfer roller 21.

Here, the sheet P is conveyed sequentially between the photosensitive drum 20 and transfer roller 21 and between the heating roller 30 and pressure roller 31, thereby forming an image on the second surface of the sheet P. Next, the discharge rollers 32, driven in the forward rotation, discharge the sheet P onto the discharge tray 13.

2. Detailed Description of the Main Casing

Figure 2:
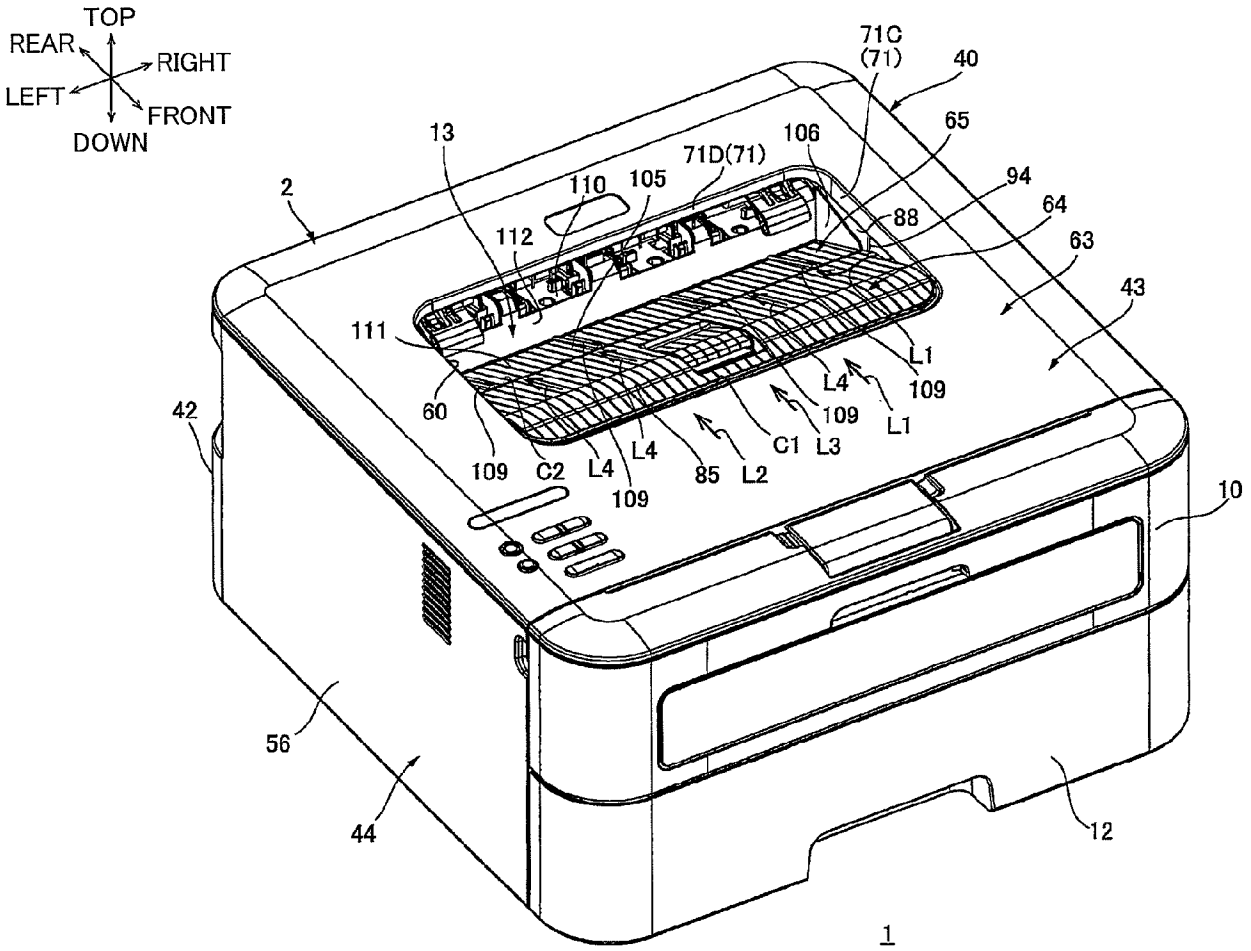
FIG. 2 is a perspective view of the printer according to the embodiment as viewed from its upper-left side.

As shown in FIGS. 1 and 2, the main casing 2 includes a right wall 40, a left wall 44, a rear wall 42, and the top wall 43.

As shown in FIG. 1, the right wall 40 constitutes a right end portion of the main casing 2 and is positioned to the right of the image-forming unit 4. The right wall 40 has a general rectangular shape in a side view and is elongated in the front-rear direction.

Figure 10:
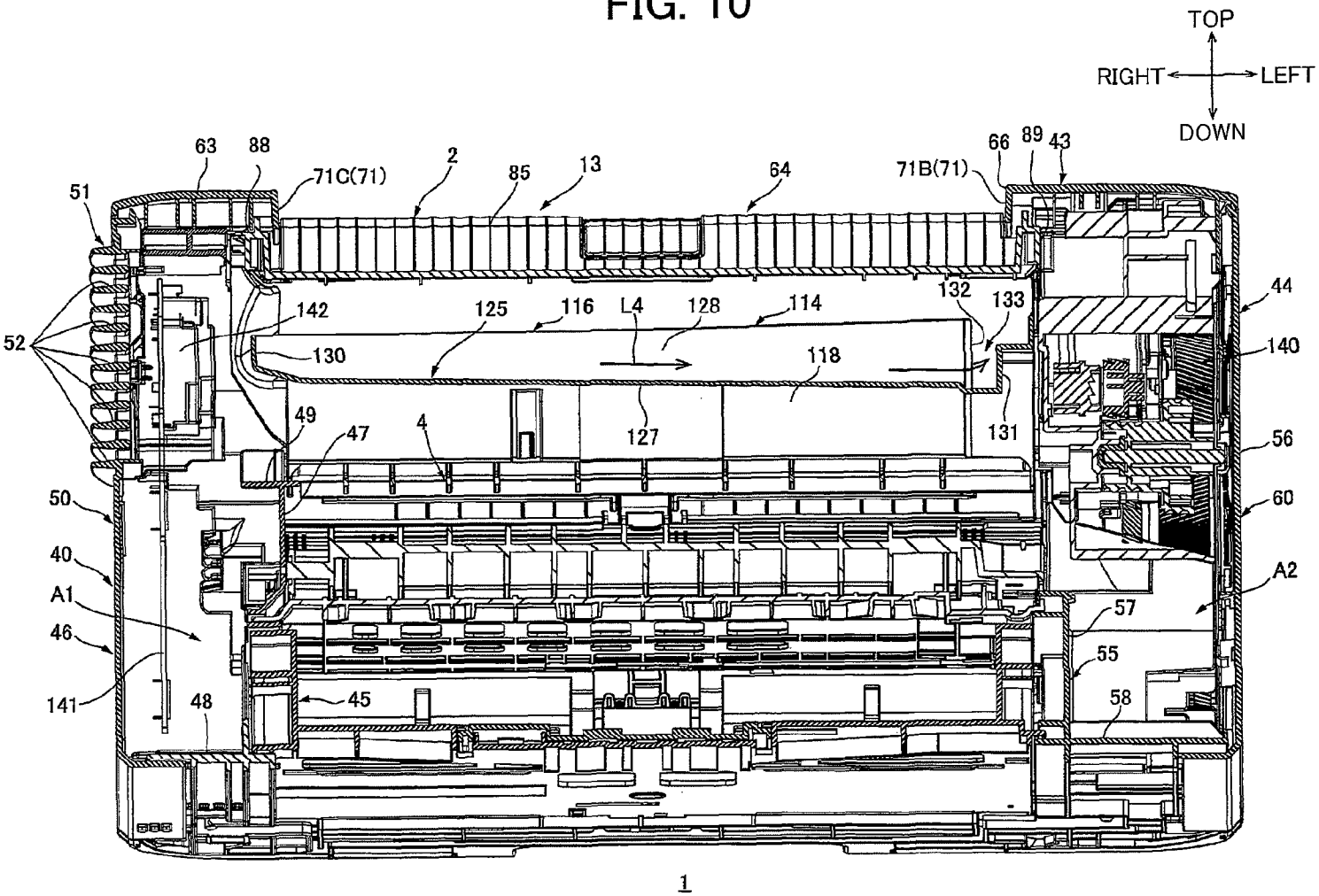
FIG. 10 is a cross-sectional rear view of the printer according to the embodiment.

As shown in FIG. 10, the right wall 40 includes a first frame 45, and a first side cover 46.

Figure 3:
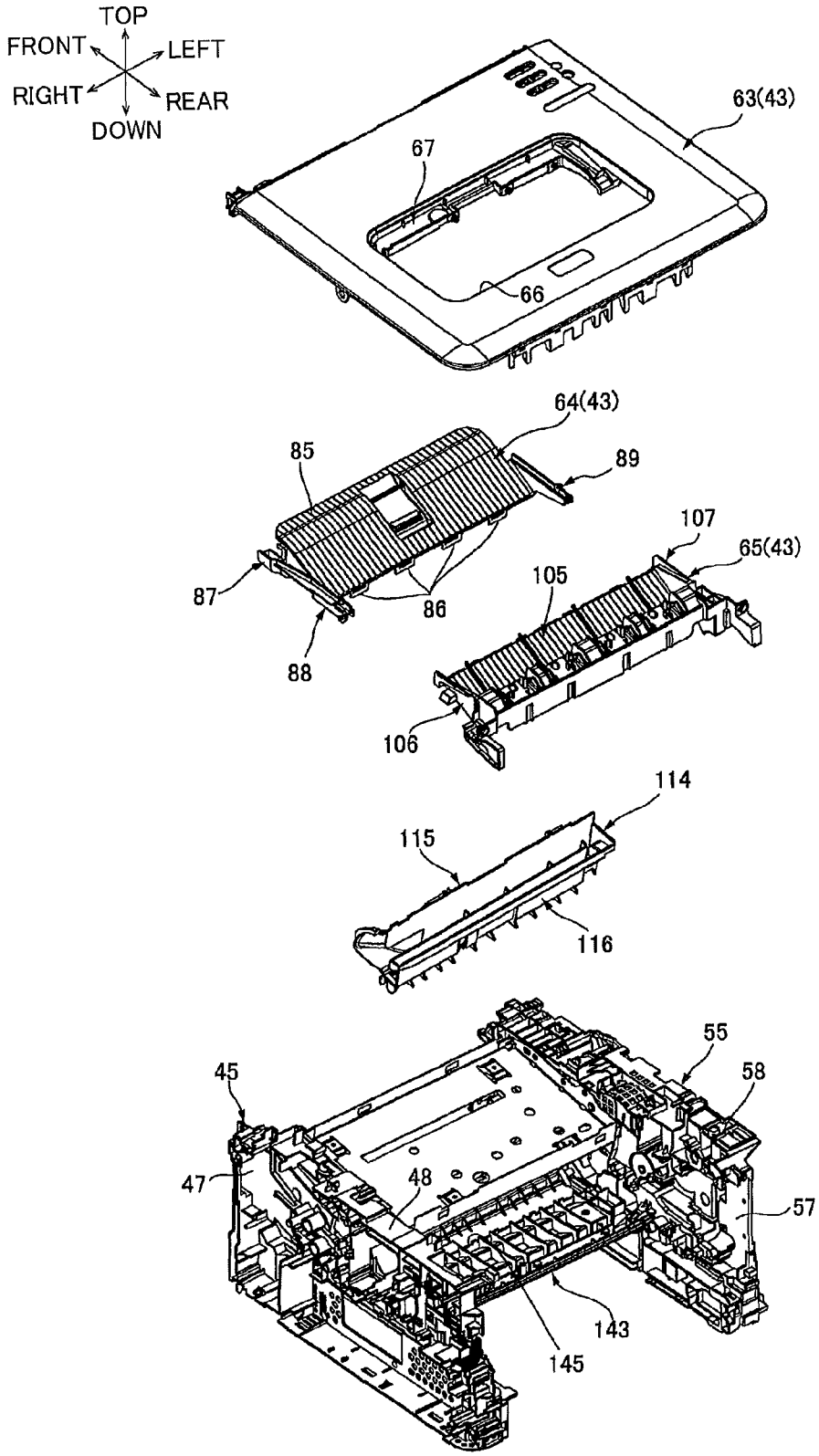
FIG. 3 is an exploded perspective view of the upper wall of the printer according to the embodiment, the upper wall including a top cover, a first tray and a second tray.

The first frame 45 constitutes a left end portion of the right wall 40. The first frame 45 is formed of a well-known resin material. As shown in FIGS. 3 and 10, the first frame 45 has a box-like shape and is open rightward.

More specifically, the first frame 45 is integrally provided with a plate 47, and a peripheral side wall 48. The plate 47 is plate-shaped with a general rectangular shape in a side view and is elongated in the front-rear direction. As shown in FIG. 3, the peripheral side wall 48 protrudes rightward from a peripheral edge of the plate 47. Thus, the first frame 45 has a concave shape in cross sections taken along the vertical direction as well as along the front-rear direction respectively.

As shown in FIG. 10, the first frame 45 has a through-hole 49 formed therein. The through-hole 49 is formed in an upper portion of the plate 47 at the approximate front-rear center thereof and is positioned to correspond to a fan 142 described later. The through-hole 49 penetrates the upper portion of the plate 47 in the left-right direction.

The first side cover 46 constitutes a right portion of the right wall 40. The first side cover 46 covers the right side of the first frame 45. The first side cover 46 is formed of a well-known resin material. The first side cover 46 is generally plate-shaped with the approximate same size and shape as the first frame 45 in a side view. The first frame 45 and first side cover 46 having the above structure constitute a first enclosure 50 having an accommodating space A1 defined therein.

The first side cover 46 has a vent 51. The vent 51 is provided in an upper portion of the first side cover 46 at an approximate front-rear center region thereof and is positioned to confront the through-hole 49 in the left-right direction with a space formed therebetween. The vent 51 is configured of a plurality of slits 52. The slits 52 penetrate the upper portion of the first side cover 46 in the left-right direction and extend in the front-rear direction. The slits 52 are arranged at regular intervals in the vertical direction.

The left wall 44 constitutes a left end portion of the main casing 2. The left wall 44 is positioned to the left of the image-forming unit 4 such that the image-forming unit 4 is interposed between the right wall 40 and left wall 44. As shown in FIG. 2, the left wall 44 has a general rectangular shape in a side view and is elongated in the front-rear direction.

As shown in FIGS. 3 and 10, the left wall 44 includes a second frame 55, and a second side cover 56.

The second frame 55 constitutes a right portion of the left wall 44. The second frame 55 is formed of a well-known resin material and has a box-like shape that is open on the left side.

More specifically, the second frame 55 is integrally provided with a plate 57, and a peripheral side wall 58. The plate 57 has a plate shape with a general rectangular shape in a side view and is elongated in the front-rear direction. As shown in FIG. 3, the peripheral side wall 58 protrudes leftward from a peripheral edge of the plate 57. Hence, the second frame 55 has a concave shape in cross sections taken along the vertical direction and along the front-rear direction, respectively.

As shown in FIG. 10, the second side cover 56 constitutes a left portion of the left wall 44. The second side cover 56 covers the left side of the second frame 55. The second side cover 56 is formed of a well-known resin material and has a generally plate shape. In a side view, the second side cover 56 has substantially the same size and shape as the second frame 55. The second frame 55 and second side cover 56 constitute a second enclosure 60 having an accommodating space A2 defined therein.

As shown in FIG. 1, the rear wall 42 constitutes a rear end portion of the main casing 2 and is positioned to the rear of the image-forming unit 4. The rear wall 42 extends in the left-right direction to connect a rear edge of the first frame 45 to a rear edge of the second frame 55.

As shown in FIG. 2, the front cover 10 is disposed between the upper portion on the front end of the first frame 45 and the upper portion on the front end of the second frame 55.

As shown in FIGS. 1 and 2, the top wall 43 constitutes an upper end portion of the main casing 2 and is positioned above the image-forming unit 4. Thus the top wall 43 forms the top surface of the main casing 2.

As shown in FIG. 3, the top wall 43 includes a top cover 63 as an example of a cover, a first tray 64 as an example of a first tray, and a second tray 65 as an example of a second tray.

Figure 4A:
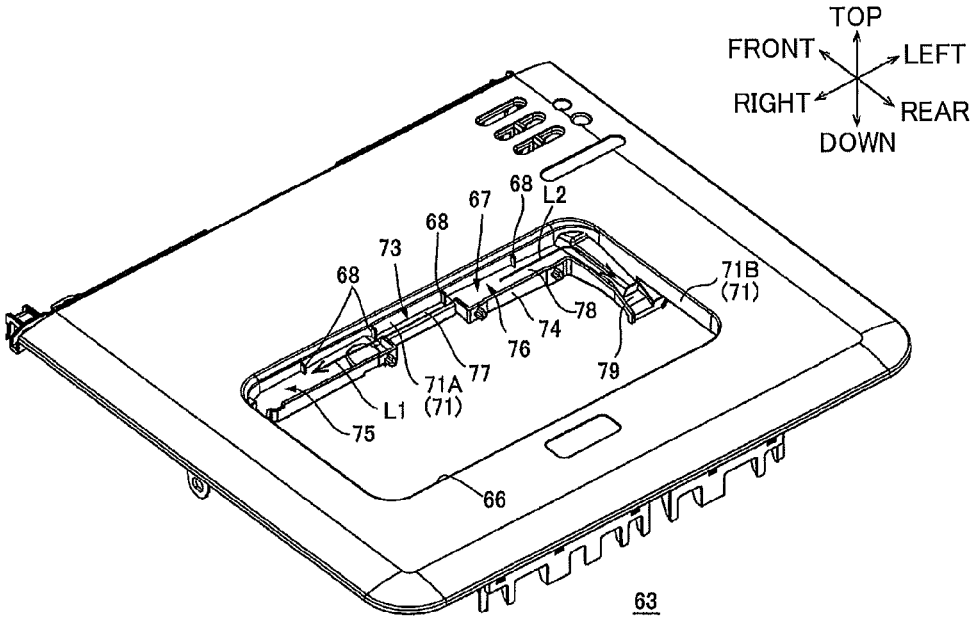
FIG. 4A is a perspective view of the top cover constituting the upper wall of the printer according to the embodiment as viewed from its upper-right side.
Figure 4B:
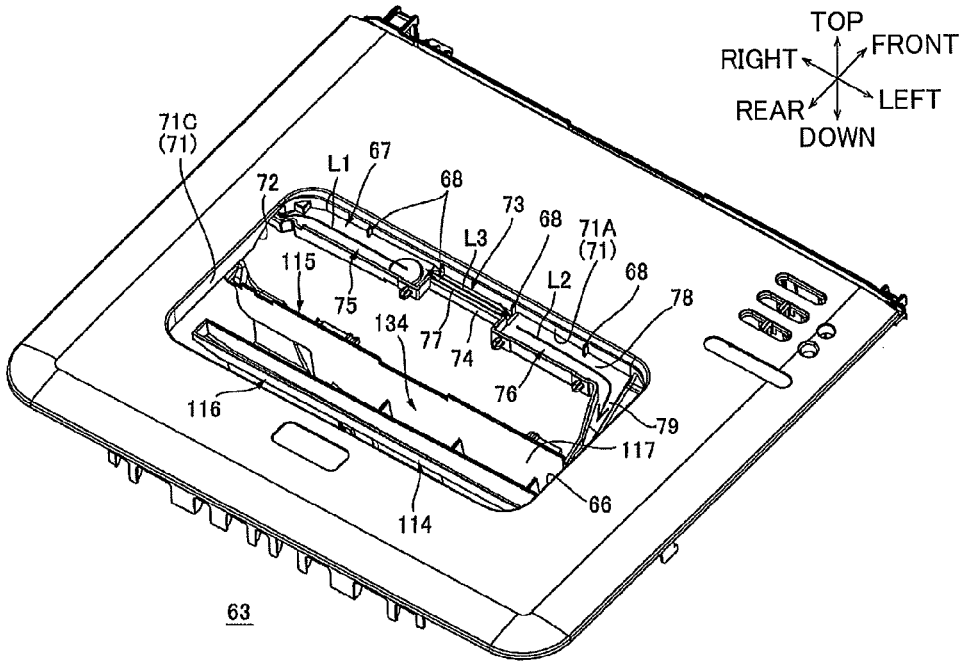
FIG. 4B is a perspective view of the top cover and the liquid-receiving unit of the printer according to the embodiment as viewed from its upper-left side, the top cover including a cover-guide part.

As shown in FIG. 2, the top cover 63 constitutes a top end portion (top surface) of the top wall 43. As shown in FIGS. 4A and 4B, the top cover 63 is plate-shaped and has a general rectangular shape in a plan view. An opening 66 is formed in the top cover 63. The opening 66 is positioned in an approximate center region of the top cover 63 and has a general rectangular shape in a plan view that is elongated in the left-right direction. The opening 66 penetrates the approximate center region of the top cover 63 vertically.

Within the opening 66, the top cover 63 is integrally provided with a protruding wall 71 as an example of a peripheral wall, a cover-guiding part 67 as an example of a cover-guide part, and four restricting protrusions 68.

The protruding wall 71 has a squared cylindrical shape that extends vertically and protrudes downward from the top cover 63, and specifically from a peripheral edge defining the opening 66. More specifically, the protruding wall 71 integrally includes a front protruding wall 71A, a left protruding wall 71B, a right protruding wall 71C and a rear protruding wall 71D. The front protruding wall 71A protrudes downward from a front peripheral edge of the opening 66. The left protruding wall 71B protrudes downward from a left peripheral edge of the opening 66. The right protruding wall 71C protrudes downward from a right peripheral edge of the opening 66. The rear protruding wall 71D protrudes downward from a rear peripheral edge of the opening 66 (see FIG. 2).

The right protruding wall 71C also includes a notched groove 72. The notched groove 72 is formed in a front end of the right protruding wall 71C (see FIG. 4B). The notched groove 72 is recessed upward in a bottom edge of the protruding wall 71 (right protruding wall 71C), forming a general V-shape in a side view, with its apex pointing obliquely upward and forward.

The cover-guiding part 67 is provided adjacent to a rear end of the front protruding wall 71A. The cover-guiding part 67 includes a guiding-part body 73, and a flange part 74.

The guiding-part body 73 is plate-shaped and extends along the front protruding wall 71A and left protruding wall 71B so as to have a general L-shape in a plan view. The guiding-part body 73 is integrally provided with a right guiding part 75 as an example of a first guide part, an intermediate part 77 as an example of a recessed part, and a left guiding part 76 as an example of a second guide part.

The right guiding part 75 constitutes a right portion of the guiding-part body 73. As shown in FIGS. 4B and 7B, the right guiding part 75 has a sloped part 81, and a protruding part 82. As shown in FIG. 4B, the sloped part 81 has a general rectangular shape in a plan view and is elongated in the left-right direction. The sloped part 81 protrudes rearward from the bottom edge of the front protruding wall 71A on the right portion thereof. As shown in FIG. 7B, the sloped part 81 slopes downward from left to right in a rear side view. Thus, the sloped part 81 has a right end (an outer end with respect to the left-right direction) that is lower than a left end of the sloped part 81 (an inner end with respect to the left-right direction).

Further, the right end of the sloped part 81 protrudes through the notched groove 72 farther rightward than the right protruding wall 71C.

The protruding part 82 has a general rectangular shape in a rear view and protrudes downward from the right end (edge) of the sloped part 81. The protruding part 82 extends across the entire right edge of the sloped part 81 in the front-rear direction.

As shown in FIG. 4B, the intermediate part 77 is formed in an approximate left-right center region of the guiding-part body 73 and is positioned between the right guiding part 75 and left guiding part 76 in the left-right direction. The intermediate part 77 has a general rectangular shape in a plan view and is elongated in the left-right direction. In a rear side view, the intermediate part 77 has a general U-shape, with the opening of the "U" facing upward. In other words, the intermediate part 77 is recessed downward. The intermediate part 77 protrudes rearward from an approximate left-right center region on the bottom edge of the front protruding wall 71A. The intermediate part 77 has a front-rear dimension that is approximately one-half of that of the sloped part 81. The right end of the intermediate part 77 is connected to the left end of the sloped part 81 at a front portion thereof.

As shown in FIG. 4A, the left guiding part 76 constitutes a left portion of the guiding-part body 73 and is disposed adjacent to the left end of the intermediate part 77. The left guiding part 76 has a general L-shape in a plan view. The left guiding part 76 extends continuously leftward from the left end of the intermediate part 77, and then bends and extends rearward.

More specifically, the left guiding part 76 includes a first sloped part 78 as an example of a sloped part, and a second sloped part 79.

The first sloped part 78 has a general rectangular shape in a plan view and is elongated in the left-right direction. The first sloped part 78 protrudes rearward from the bottom edge of the front protruding wall 71A in a left region thereof. In a rear side view, the first sloped part 78 slopes downward from right to left, as shown in FIG. 7B. That is, the first sloped part 78 slopes such that the left end (an outer end in the left-right direction) is lower than the right end (an inner end in the left-right direction).

The first sloped part 78 has a front-rear dimension substantially equivalent to the front-rear dimension of the sloped part 81 of the right guiding part 75. The front part on the right end of the first sloped part 78 is connected to the left end of the intermediate part 77, and the left end of the first sloped part 78 is connected to a front portion of the left protruding wall 71B.

The second sloped part 79 has a general rectangular shape in a plan view and is elongated in the front-rear direction. In a side view, the second sloped part 79 slopes downward from its front end toward its rear end. The second sloped part 79 has a front end connected to a rear edge on the left end of the first sloped part 78. The left edge of the second sloped part 79 is connected to the left protruding wall 71B.

The flange part 74 protrudes upward from inside edges of the cover-guiding part 67. More specifically, the flange part 74 protrudes upward from the rear edge of the sloped part 81, the rear portion on the left edge of the sloped part 81, the rear edge of the intermediate part 77, the rear portion on the right edge of the first sloped part 78, the rear edge of the first sloped part 78, and the right edge of the second sloped part 79.

The restricting protrusions 68 are arranged on the rear surface of the front protruding wall 71A above the guiding-part body 73. A plurality of the restricting protrusions 68, and specifically four restricting protrusions 68 in the embodiment, are arranged at intervals in the left-right direction. The restricting protrusions 68 are plate-shaped and have a general rectangular shape in a side view. The restricting protrusions 68 protrude rearward from the rear surface of the front protruding wall 71A. The bottom edges of the restricting protrusions 68 are connected to the top surface of the guiding-part body 73. The restricting protrusions 68 have a greater vertical dimension than the flange part 74.

As shown in FIGS. 2 and 3, the top cover 63 is arranged in the upper end portion of the main casing 2 so as to cover top surfaces of the right wall 40, left wall 44, and rear wall 42. In other words, the top cover 63 forms part of the top surface of the main casing 2.

When viewed from above, the first tray 64 is arranged in a front portion of the opening 66, as shown in FIG. 2.

Figure 5A:
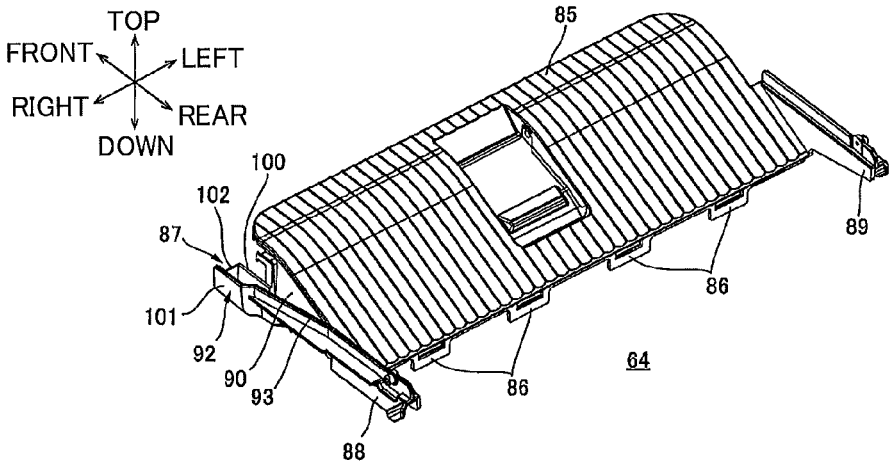
FIG. 5A is a perspective view of the first tray constituting the upper wall of the printer according to the embodiment as viewed from its upper-right side.
Figure 5B:
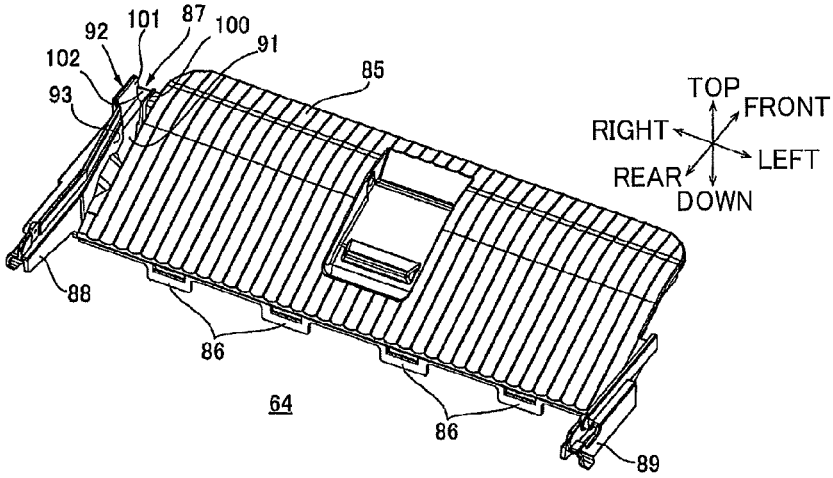
FIG. 5B is a perspective view of the first tray shown in FIG. 5A as viewed from its upper-left side.
Figure 5C:
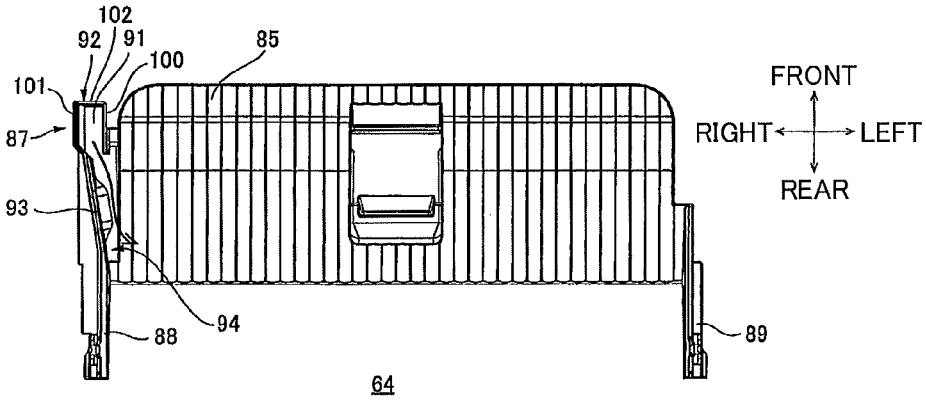
FIG. 5C is a plan view of the first tray shown in FIG. 5B.

As shown in FIGS. 5A through 5C, the first tray 64 is integrally provided with a first-tray body 85, four receiving parts 86, a first-tray guiding part 87 as an example of a receiving part, a right engaging part 88, and a left engaging part 89.

As shown in FIG. 5C, the first-tray body 85 is plate-shaped and has a general rectangular shape in a plan view that is elongated in the left-right direction. In a side view, the first-tray body 85 slopes downward toward the rear, as illustrated in FIG. 1.

As shown in FIGS. 5A and 5B, the receiving parts 86 are disposed beneath and adjacent to the rear edge of the first-tray body 85. A plurality of the receiving parts 86 (four receiving parts 86) is arranged at intervals in the left-right direction. The receiving parts 86 are plate-shaped and have a U-shape in a rear view, with the opening of the "U" facing upward. Top ends of the receiving parts 86 are connected to the rear edge of the first-tray body 85.

As shown in FIGS. 5A through 5C, the first-tray guiding part 87 is disposed on the right of and adjacent to the first-tray body 85. The first-tray guiding part 87 has a side plate 90, a bottom plate 91 as an example of a bottom part, an enclosing plate 92 as an example of an enclosing part, and a sloped plate 93.

As shown in FIG. 5A, the side plate 90 has a general triangular shape in a side view and protrudes downward from the right edge of the first-tray body 85. The bottom edge of the side plate 90 extends in the front-rear direction.

As shown in FIG. 5C, the bottom plate 91 forms a bottom surface of the first-tray guiding part 87. The bottom plate 91 has a general rectangular shape in a plan view and is elongated in the front-rear direction. In a side view, the bottom plate 91 slopes downward toward the rear. The bottom plate 91A has a front portion whose left edge is formed with a notch having a general rectangular shape in a plan view. The bottom plate 91 has a rear portion whose left edge is connected to the right surface of the side plate 90 at the bottom edge thereof. As shown in FIG. 5B, the top surface on the rear end of the bottom plate 91 is formed continuously with the top surface of the first-tray body 85 in the left-right direction.

As shown in FIG. 5C, the enclosing plate 92 is disposed on the top surface of the bottom plate 91 in a front region thereof. The enclosing plate 92 has a general U-shape in a plan view, with the opening of the "U" facing rearward. The enclosing plate 92 protrudes upward from peripheral edges of the front portion of the bottom plate 91.

More specifically, the enclosing plate 92 has a left plate 100, a right plate 101 as an example of a wall part, and a front plate 102.

The left plate 100 constitutes a left end of the enclosing plate 92. As shown in FIG. 5A, the left plate 100 is plate-shaped and has a general rectangular shape in a side view that is elongated in the front-rear direction. As shown in FIG. 7B, the left plate 100 extends upward from the left edge of the bottom plate 91 in the front portion thereof.

The right plate 101 constitutes a right end of the enclosing plate 92 and is disposed to the right of and apart from the left plate 100. As shown in FIG. 5A, the right plate 101 is plate-shaped and has a general rectangular shape in a side view that is elongated in the front-rear direction. As shown in FIG. 7B, the right plate 101 extends upward from the right edge on the front portion of the bottom plate 91. The right plate 101 has a larger vertical dimension than the left plate 100.

As shown in FIG. 5C, the front plate 102 constitutes a front end of the enclosing plate 92 and bridges the front edges of the left plate 100 and the lower portion of the right plate 101. As shown in FIG. 5B, the front plate 102 extends upward from the front edge of the bottom plate 91. The front plate 102 has a vertical dimension that is approximately equal to the vertical dimension of the left plate 100.

The sloped plate 93 extends continuously from the rear end of the right plate 101 constituting the enclosing plate 92, sloping leftward toward the rear. The sloped plate 93 has a bottom edge that is connected to the top surface of the bottom plate 91, as shown in FIG. 5B.

The right engaging part 88 is disposed adjacent to the rear end of the first-tray guiding part 87. The right engaging part 88 has a general squared U-shape in a rear side view, with the opening of the "U" facing downward, and is elongated in the front-rear direction. The right engaging part 88 has a front end portion whose left edge is connected to the rear end of the sloped plate 93. The right engaging part 88 has a left surface whose front end portion is connected to the right edge of the first-tray body 85 at the rear end thereof.

As shown in FIG. 5A, the left engaging part 89 is disposed adjacent to the first-tray body 85 on the left side thereof. The left engaging part 89 has a general squared U-shape in a rear side view, with the opening of the "U" facing downward, and is elongated in the front-rear direction. The left engaging part 89 has a right surface whose front portion is connected to the left edge of the first-tray body 85 on the rear portion thereof.

As shown in FIGS. 2 and 10, the first tray 64 is disposed in the front portion of the opening 66, such that the front edge of the first-tray body 85 is positioned adjacent to the front protruding wall 71A on the rear side, and the left and right edges of the first-tray body 85 at the front end thereof are positioned adjacent to the left protruding wall 71B and right protruding wall 71C on the left-right inner sides, respectively. In other words, when viewed from above, the first tray 64 is adjacent to the front peripheral edge of the opening 66 defined in the top cover 63 in the front-rear direction, as shown in FIG. 2.

According to this configuration, a gap C1 (as an example of a second gap) extending in the left-right direction is defined between the front edge of the first-tray body 85 and the front peripheral edge of the opening 66 formed in the top cover 63.

As shown in FIG. 7B, the first-tray body 85 has a front end portion whose bottom surface is in contact with top ends of the restricting protrusions 68. Accordingly, as shown in FIG. 1, the front end portion of the first-tray body 85 overlaps the guiding-part body 73 in the top-down direction, with a gap formed therebetween.

As shown in FIG. 7B, the first-tray guiding part 87 is disposed rightward of the right protruding wall 71C and beneath the right edge of the sloped part 81 constituting the right guiding part 75. The first-tray guiding part 87 is also arranged with the front portion of the bottom plate 91 beneath and separated from the right end of the sloped part 81 so as to overlap the right end of the sloped part 81 vertically. Further, the left plate 100 of the enclosing plate 92 is disposed to the left of the right edge of the sloped part 81 and beneath and separated from the right end of the sloped part 81. Further, the right plate 101 of the enclosing plate 92 is disposed to the right of the right edge of the sloped part 81, with the upper portion of the right plate 101 disposed to the right of and separated from the right edge of the sloped part 81 so as to overlap the sloped part 81 in the left-right direction. Further, the top edge of the right plate 101 is positioned higher than the right edge of the sloped part 81.

As shown in FIG. 10, the right engaging part 88 is disposed to the right of the right protruding wall 71C, and the left engaging part 89 is disposed to the left of the left protruding wall 71B.

As shown in FIG. 2, an opening 94 is defined by the bottom edge of the right protruding wall 71C, the right edge of the first-tray body 85, and the front edge on the left side of the right engaging part 88. The opening 94 provides communication between the first-tray guiding part 87 and discharge tray 13 in the left-right direction (also see FIG. 5C).

As shown in FIG. 2, the second tray 65 is disposed in a rear portion of the opening 66 when viewed from above.

Figure 6A:
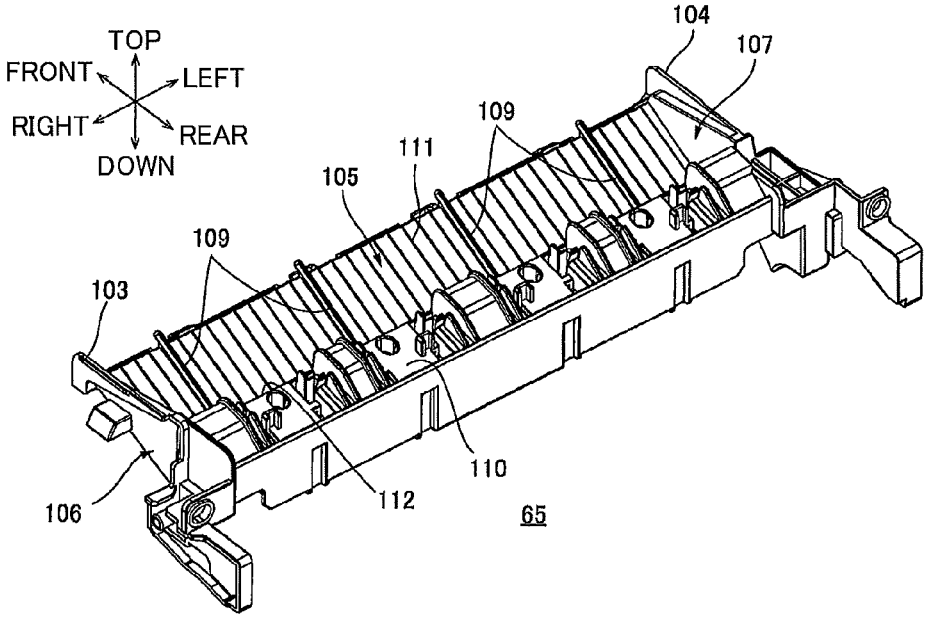
FIG. 6A is a perspective view of the second tray constituting the upper wall of the printer according to the embodiment as viewed from its upper-right side.
Figure 6B:
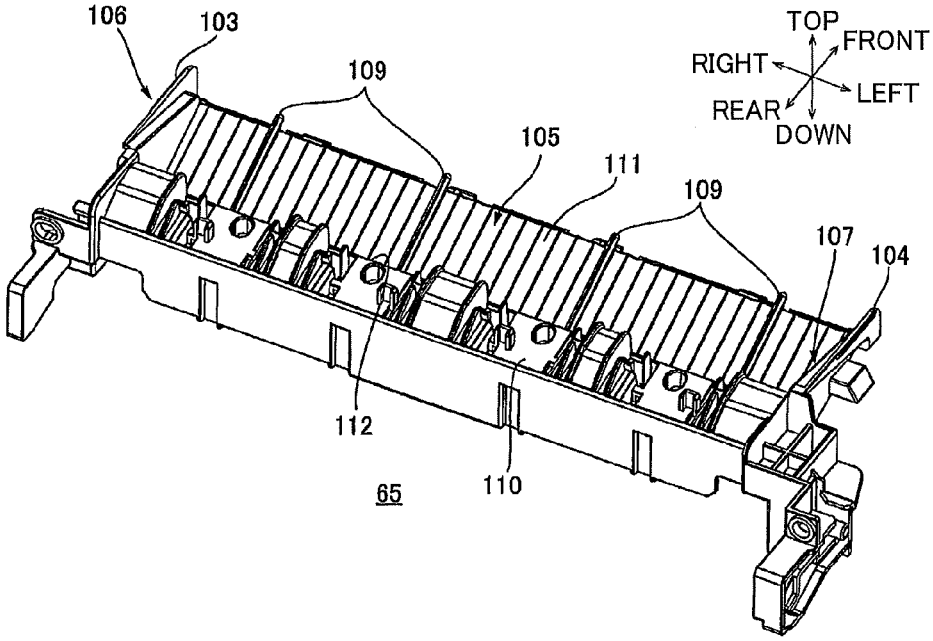
FIG. 6B is a perspective view of the second tray shown in FIG. 6A as viewed from its upper-left side.
Figure 7A:
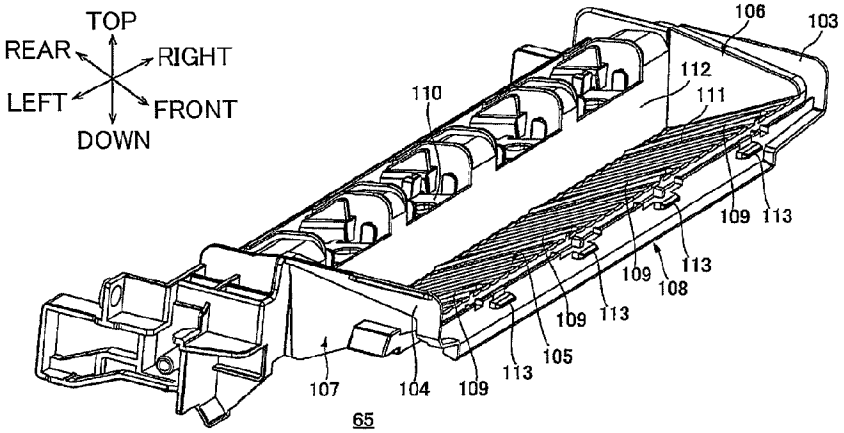
FIG. 7A is a perspective view of the second tray constituting the upper wall of the printer according to the embodiment as viewed from its front-left side.
Figure 7B:
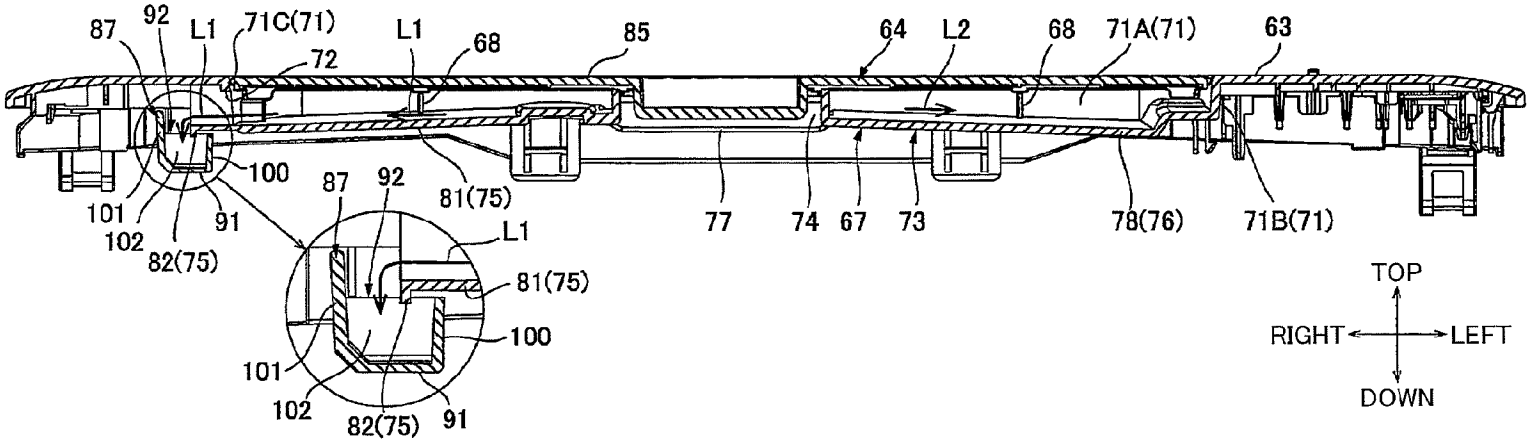
FIG. 7B is a cross-sectional rear view of the cover-guide part of the top cover constituting the upper wall of the printer of the according to the embodiment.

As shown in FIGS. 6A, 6B, and 7A, the second tray 65 integrally includes a second-tray body 105, a roller supporting wall 110, a second-tray guiding part 108 as an example of a guide part, four engaging protrusions 113, a right engaging wall 106, and a left engaging wall 107.

As shown in FIG. 1, the second-tray body 105 is plate-shaped with a general L-shape in a side view. The second-tray body 105 is integrally configured of a sloped wall 111, and a vertical wall 112.

The sloped wall 111 constitutes a front portion of the second-tray body 105. As shown in FIG. 6A, the sloped wall 111 is plate-shaped and has a general rectangular shape in a plan view that is elongated in the left-right direction. In a side view, the sloped wall 111 slopes downward toward the rear, as shown in FIG. 1.

As shown in FIG. 6B, the sloped wall 111 has a top surface on which protruding ridges 109 are formed. A plurality of the protruding ridges 109, and specifically four protruding ridges 109, is arranged at intervals in the left right direction. The protruding ridges 109 have a rail-like shape and extend downward toward the rear. The protruding ridges 109 are connected to the top surface of the sloped wall 111, with front ends of the protruding ridges 109 protruding farther above and forward than the front edge of the sloped wall 111.

The vertical wall 112 constitutes a rear portion of the second-tray body 105. The vertical wall 112 is plate-shaped and generally rectangular in a rear side view and is elongated in the left-right direction. As shown in FIG. 1, the vertical wall 112 extends continuously upward from the rear edge of the sloped wall 111.

As shown in FIG. 6A, the roller supporting wall 110 extends continuously rearward from the upper end of the vertical wall 112. The roller supporting wall 110 is plate-shaped and has a general rectangular shape in a plan view that is elongated in the left-right direction. As shown in FIG. 1, the discharge rollers 32 are rotatably supported in a top surface of the roller supporting wall 110. Note that the discharge rollers 32 have been omitted from the drawings in FIGS. 2, 3, 6A, 6B, and 7A to facilitate the description.

As shown in FIG. 1, the second-tray guiding part 108 is disposed on a bottom surface of the sloped wall 111 on the front end thereof. As shown in FIG. 7A, the second-tray guiding part 108 has a plate shape with a general L-shape in a side view. As shown in FIG. 1, the printer 1 first extends continuously downward from the front end portion of the sloped wall 111, and then bends and extends diagonally downward and forward.

As shown in FIG. 7A, the four engaging protrusions 113 are provided to correspond to the four receiving parts 86. The four engaging protrusions 113 are disposed on a front surface of the second-tray guiding part 108 at an upper portion thereof and are arranged at intervals in the left-right direction. The engaging protrusions 113 have a general rectangular shape in a plan view and protrude frontward from the front surface of the upper portion of the second-tray guiding part 108.

As shown in FIG. 6B, the right engaging wall 106 constitutes a right end of the second tray 65. The right engaging wall 106 extends continuously upward from the right edge of the sloped wall 111. The right engaging wall 106 is plate-shaped and has a general triangular shape in a side view, with its apex pointed forward. The right engaging wall 106 has a rear end connected to the right edge of the vertical wall 112. The right engaging wall 106 has a top edge extending in the front-rear direction. In a side view, the top edge of the right engaging wall 106 extends from the front end of the sloped wall 111 to the top end of the vertical wall 112.

The right engaging wall 106 integrally includes a right engaging rib 103. The right engaging rib 103 protrudes upward from a right portion on the top edge of the right engaging wall 106. The right engaging rib 103 is plate-shaped and has a general triangular shape in a side view with its apex pointing rearward. The right engaging rib 103 has a top edge extending in the front-rear direction.

As shown in FIG. 6A, the left engaging wall 107 constitutes a left end of the second tray 65. The left engaging wall 107 extends continuously upward from the left edge of the sloped wall 111. The left engaging wall 107 is plate-shaped and has a general triangular shape in a side view with its apex pointing forward. The left engaging wall 107 has a rear end connected to the left edge of the vertical wall 112. The top edge of the left engaging wall 107 extends in the front-rear direction. In a side view, the top edge of the left engaging wall 107 extends from the front end of the sloped wall 111 to the top end of the vertical wall 112.

The left engaging wall 107 has an integrally-provided left engaging rib 104. The left engaging rib 104 extends continuously upward from a left portion on the top edge of the left engaging wall 107. The left engaging rib 104 is plate-shaped and has a general triangular shape in a side view with its apex pointing rearward. The top edge of the left engaging rib 104 extends in the front-rear direction.

As shown in FIGS. 2, 5B, and 7A, the second tray 65 is disposed in the rear portion of the opening 66 with the engaging protrusions 113 inserted into the corresponding receiving parts 86 from its rear side and the front edge of the sloped wall 111 positioned to the rear of and adjacent to the rear edge of the first-tray body 85. In other words, the first tray 64 is disposed downstream of the second tray 65 in the discharge direction X, as shown in FIG. 1. The left and right edges of the second tray 65 are respectively supported in the second frame 55 and first frame 45.

As shown in FIG. 2, a gap C2 (as an example of a first gap) extending in the left-right direction is defined between neighboring portions of the sloped wall 111 and first-tray body 85, i.e., between the front edge of the sloped wall 111 and the rear edge of the first-tray body 85.

As shown in FIG. 1, the top end of the vertical wall 112 is positioned beneath the bottom end of the rear protruding wall 71D with a gap formed therebetween.

As shown in FIGS. 2, 5B, and 6B, the right engaging rib 103 is received in the right engaging part 88 from below, and the left engaging rib 104 is received in the left engaging part 89 from below. The first tray 64 and second tray 65 together form the discharge tray 13.

3. Driving Mechanism, Control Board, and Fan

As shown in FIG. 10, the printer 1 includes a control board 141 as an example of a circuit board, the fan 142, and a gear mechanism 140.

The control board 141 and fan 142 are accommodated in the accommodating space A1 formed in the right wall 40. The control board 141 is configured to control the operations of the image-forming unit 4. The control board 141 has a plate shape that is generally rectangular shape in a side view and elongated vertically. The control board 141 is fixed to the right surface of the plate 47 constituting the first frame 45.

The fan 142 is configured to generate a flow of air within the main casing 2. The fan 142 is disposed between the through-hole 49 and vent 51 in the left-right direction and is fixed to the right surface of the plate 47 constituting the first frame 45. When the fan 142 is driven, air inside the first enclosure 50 is exhausted from the main casing 2 through the vent 51, and air inside the main casing 2 is drawn toward the fan 142 through the through-hole 49. As a result, air near the bottom end of a duct unit 115 (described later) flows upward through through-holes 121 (described later) and a passage 134 (described later) and is exhausted outside from the main casing 2 through the through-hole 49 and vent 51.

As shown in FIG. 10, the gear mechanism 140 is accommodated in the accommodating space A2 formed in the left wall 44. The gear mechanism 140 is configured to transmit a drive force to the image-forming unit 4. The gear mechanism 140 includes a plurality of gears that are supported on the left surface of the plate 57 constituting the second frame 55.

4. Liquid-Receiving Unit

As shown in FIG. 1, the printer 1 is also provided with a liquid-receiving unit 114.

The liquid-receiving unit 114 is disposed below the discharge tray 13, to the upper rear side of the process cartridge 15, and to the upper front side of the fixing unit 17.

Figure 8A:
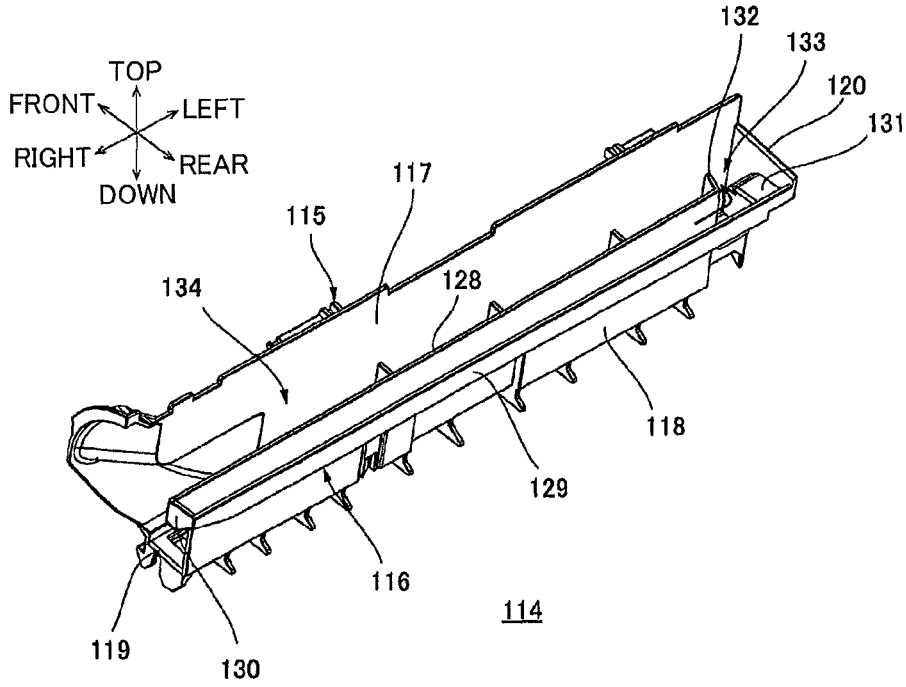
FIG. 8A is a perspective view of the liquid-receiving unit of the printer according to the embodiment as viewed from its upper-right side.
Figure 8B:
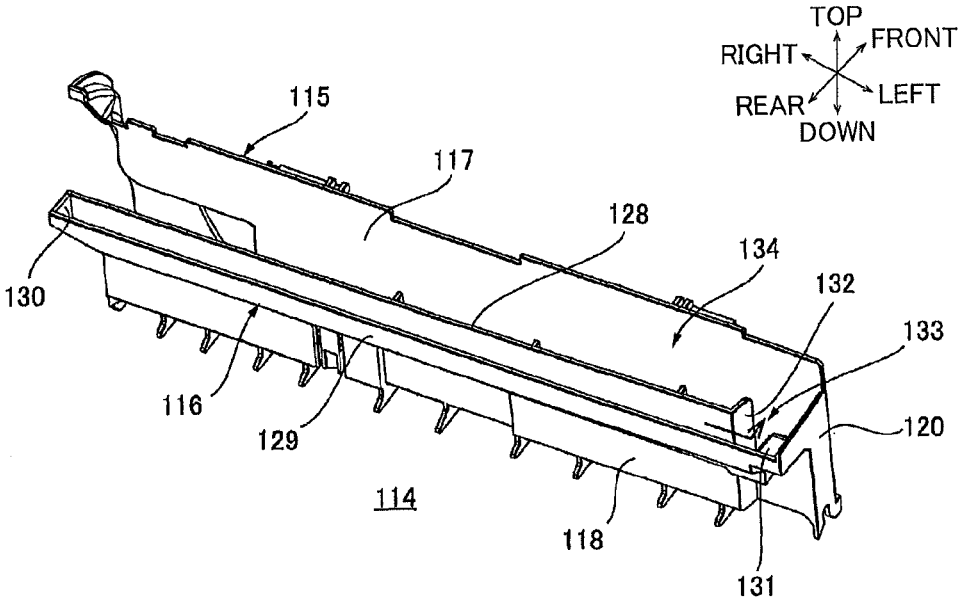
FIG. 8B is a perspective view of the liquid-receiving unit shown in FIG. 8A as viewed from its upper-left side.

As shown in FIGS. 8A and 8B, the liquid-receiving unit 114 integrally includes the duct unit 115 as an example of a duct, and a liquid-receiving member 116 as an example of a receiving unit.

The duct unit 115 constitutes a front portion of the liquid-receiving unit 114. The duct unit 115 has a first duct wall 117, a second duct wall 118, a first coupling part 119, and a second coupling part 120.

The first duct wall 117 constitutes a front portion of the duct unit 115. The first duct wall 117 is plate-shaped and has a general rectangular shape in a front view that is elongated in the left-right direction. The second duct wall 118 is positioned to confront the first duct wall 117 in the front-rear direction with a gap formed therebetween. The second duct wall 118 has a general rectangular shape in a rear view that is elongated in the left-right direction. The second duct wall 118 has a vertical dimension approximately one-half of the vertical dimension of the first duct wall 117. The second duct wall 118 has a top end lower than the top end of the first duct wall 117.

Figure 9:
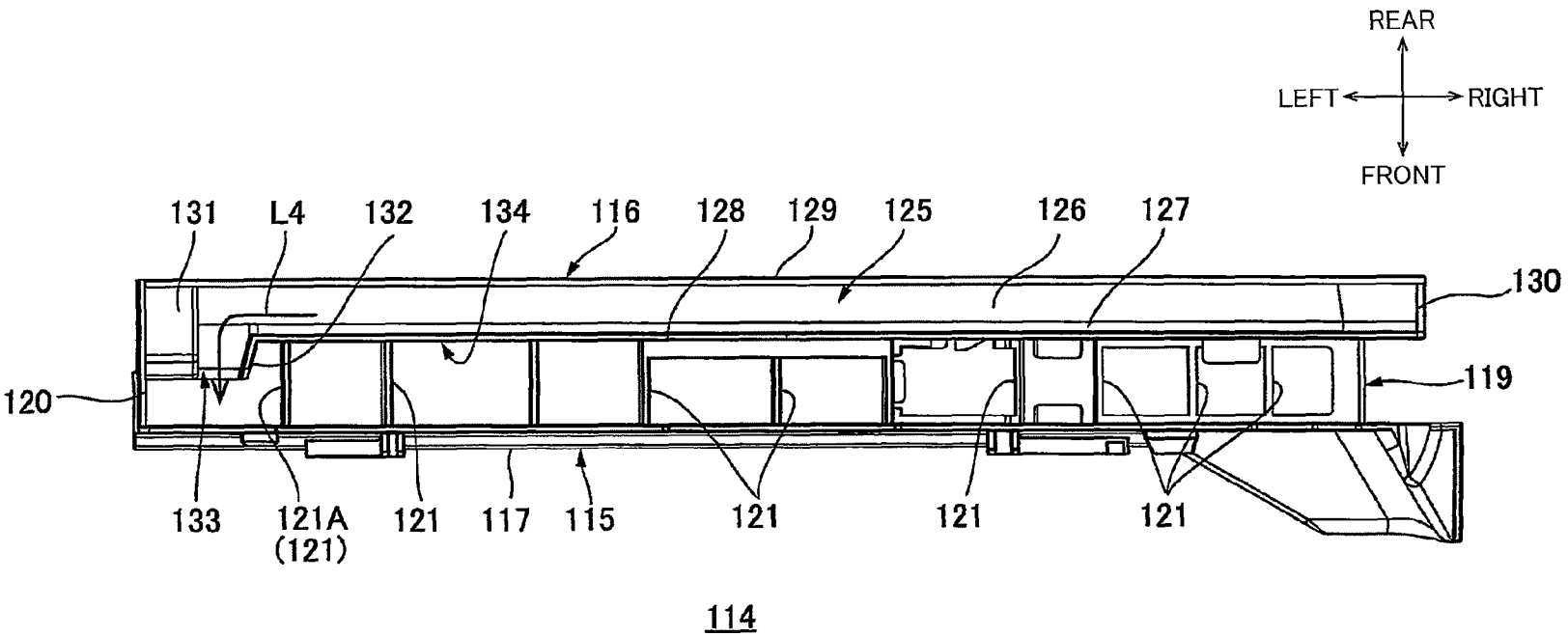
FIG. 9 is a perspective view of the liquid-receiving unit of the printer according to the embodiment as viewed from its upper-rear side.

As shown in FIGS. 8A and 9, the first coupling part 119 connects bottom edges of the first duct wall 117 and second duct wall 118. As shown in FIG. 9, the first coupling part 119 is plate-shaped and has a general rectangular shape in a plan view that is elongated in the left-right direction. The first coupling part 119 has a plurality of through-holes 121 formed therein. The through-holes 121 are arranged at intervals in the left-right direction. The through-holes 121 have a general rectangular shape in a plan view and penetrate the first coupling part 119 vertically. Note that when viewing the through-holes 121 from a point obliquely above and rearward therefrom, a leftmost through-hole 121A of the through-holes 121 is aligned with a liquid outlet 133 described later.

As shown in FIG. 8B, the second coupling part 120 connects left edges of the first duct wall 117 and second duct wall 118. The second coupling part 120 is plate-shaped and has a general rectangular shape in a side view that is elongated vertically.

The first duct wall 117, second duct wall 118, and second coupling part 120 define the passage 134 (see FIGS. 1 and 9).

The liquid-receiving member 116 is positioned above and adjacent to the second duct wall 118 and is disposed rearward of an upper portion of the first duct wall 117 with a gap formed therebetween.

The liquid-receiving member 116 has a concave shape that opens upward and is elongated in the left-right direction. The liquid-receiving member 116 integrally includes a first guiding wall 128 as an example of a first wall, a second guiding wall 129 as an example of a second wall, a receiving wall 125, an enclosing wall 130, a restricting wall 131 as an example of a third wall, and an extending wall 132 as an example of a fourth wall.

The first guiding wall 128 constitutes a front portion of the liquid-receiving member 116. As shown in FIG. 10, the first guiding wall 128 is plate-shaped and has a general trapezoidal shape in a rear view that grows narrower toward the right. More specifically, the first guiding wall 128 has a top edge sloping downward from left to right, and a bottom edge sloping upward from left to right.

As shown in FIGS. 8A and 8B, the second guiding wall 129 confronts the first guiding wall 128 from the rear side with a gap formed therebetween. The second guiding wall 129 is plate-shaped and has a general trapezoidal shape in a front view that grows narrower toward the right end. More specifically, the second guiding wall 129 has a top edge extending in the same direction as the top edge of the first guiding wall 128, and a bottom edge extending in the same direction as the bottom edge of the first guiding wall 128. The second guiding wall 129 has a left-right dimension greater than that of the first guiding wall 128, while the second guiding wall 129 has a vertical dimension smaller than that of the first guiding wall 128.

When viewing the second guiding wall 129 in the front-rear direction, the top edge of the second guiding wall 129 is approximately aligned with the top edge of the first guiding wall 128. Consequently, since the second guiding wall 129 has a smaller vertical dimension, the bottom edge of the second guiding wall 129 is positioned higher than the bottom edge of the first guiding wall 128. Further, the right edge of the second guiding wall 129 is approximately aligned with the right edge of the first guiding wall 128.

The receiving wall 125 bridges the bottom edges of the first guiding wall 128 and second guiding wall 129.

As shown in FIG. 1, the receiving wall 125 is plate-shaped and has a general L-shape in a side view. The receiving wall 125 includes a first portion 126, and a second portion 127. The first portion 126 constitutes a rear portion of the receiving wall 125 and slopes continuously downward toward the front from the bottom edge of the second guiding wall 129. In other words, the second guiding wall 129 extends continuously upward from the rear edge of the first portion 126.

The second portion 127 constitutes a front portion of the receiving wall 125. The second portion 127 extends continuously forward from the bottom edge of the first portion 126 and is connected to the bottom edge of the first guiding wall 128. That is, the first guiding wall 128 extends continuously upward from the front edge of the second portion 127. As shown in FIG. 10, the second portion 127 slopes downward from right to left. In other words, the second portion 127 extends in a direction from the upper right toward the lower left. Thus, at least a portion of the receiving wall 125, and specifically the second portion 127, slopes downward from the first frame 45 side toward the second frame 55 side.

As shown in FIG. 8A, the enclosing wall 130 bridges the right edges of the first guiding wall 128 and second guiding wall 129. The enclosing wall 130 has a bottom edge connected to the right edge of the receiving wall 125.

As shown in FIG. 10, the restricting wall 131 constitutes a left end of the liquid-receiving member 116 and has a crank-like plate shape in a rear side view. The restricting wall 131 first extends upward from the left edge of the receiving wall 125, then bends and extends leftward, and then bends and extends upward. As shown in FIGS. 8A and 8B, the restricting wall 131 has an upper portion whose front end is connected to the upper end of the rear edge of the second coupling part 120, and a rear end of the restricting wall 131 is connected to the left end of the second guiding wall 129.

The restricting wall 131 has a bottom portion that is disposed in a position leftward of the left end of the first guiding wall 128 to confront the same in the left-right direction with a gap formed therebetween.

As shown in FIGS. 8B and 9, the extending wall 132 is formed continuously with the left edge of the first guiding wall 128 and protrudes diagonally leftward and forward, away from the second guiding wall 129. The extending wall 132 is plate-shaped and has a general rectangular shape in a side view that is elongated vertically.

The left edge of the first guiding wall 128, the bottom portion of the restricting wall 131, and the left end of the receiving wall 125 positioned between these components defines the liquid outlet 133. The liquid outlet 133 has a general U-shape in a rear side view, with the opening of the "U" facing upward. The liquid outlet 133 provides communication in the front-rear direction between the interior space of the liquid-receiving member 116 and the passage 134.

As shown in FIG. 1, the liquid-receiving unit 114 is disposed such that the liquid-receiving member 116 is positioned beneath the gap C2, and the bottom portion of the duct unit 115 is positioned between the process cartridge 15 and fixing unit 17 in the front-rear direction.

With this configuration, the receiving wall 125 is disposed below the second-tray guiding part 108 and confronts the second-tray guiding part 108 vertically with a gap formed therebetween. Further, the first guiding wall 128 is positioned forward of the second-tray guiding part 108, and the second guiding wall 129 is positioned rearward of the second-tray guiding part 108.

As shown in FIG. 4B, the left end of the duct unit 115 is disposed beneath the rear end of the second sloped part 79 constituting the left guiding part 76; the left end of the first duct wall 117 is positioned forward from the rear edge of the second sloped part 79; the left end of the second duct wall 118 is positioned rearward from the rear edge of the second sloped part 79; and the second coupling part 120 (not shown in FIG. 4B) is positioned to the left of the left edge of the second sloped part 79. Thus, the left end of the passage 134 is vertically aligned with the rear edge of the second sloped part 79.

5. First Conveyance Guide and Second Conveyance Guide

As shown in FIG. 1, the first conveyance guide 34 includes a first conveying member 143 for guiding conveyance of the sheet P toward the position between the heating roller 30 and pressure roller 31 after the sheet P has passed between the photosensitive drum 20 and transfer roller 21.

The first conveying member 143 is elongated in the front-rear direction and is positioned such that its front part is beneath the process cartridge 15 and its rear part is below and separated from the duct unit 115. As shown in FIG. 3, the first conveying member 143 is plate-shaped and has a general rectangular shape in a plan view that is elongated in the left-right direction. The first conveying member 143 has left and right ends respectively fixed to the plate 57 of the second frame 55 and the plate 47 of the first frame 45.

The first conveying member 143 also has a first liquid passage 145. The first liquid passage 145 is disposed in a rear portion of the first conveying member 143 at a position that is vertically aligned with the passage 134 formed in the duct unit 115. As shown in FIG. 3, the first liquid passage 145 has a general rectangular shape in a plan view and is elongated in the left-right direction. The first liquid passage 145 penetrates the rear portion of the first conveying member 143 vertically.

As shown in FIG. 1, the second conveyance guide 35 includes a second conveying member 144 for guiding conveyance of the sheet P passing over the paper tray 12 from the rear side toward the front side. The second conveying member 144 is positioned beneath and separated from the first conveying member 143 and positioned above and separated from the paper tray 12. The first conveying member 143 and second conveying member 144 define a gap in the top-down direction therebetween that constitutes a part of the re-conveying path P2.

The second conveying member 144 has a plate shape that is generally rectangular in a plan view and elongated in the left-right direction. The second conveying member 144 has left and right ends that are respectively fixed to the plate 57 of the second frame 55 and the plate 47 of the first frame 45.

The second conveying member 144 also has a second liquid passage 146 formed therein. The second liquid passage 146 is formed in a position aligned with the first liquid passage 145 in the vertical direction. The second liquid passage 146 has a general rectangular shape in a plan view and is elongated in the left-right direction. The second liquid passage 146 penetrates the second conveying member 144 vertically.

6. Liquid-Guiding Function (1) Liquid Guided by the Cover-Guiding Part

Next, how liquid is guided in the printer 1 when the liquid is accidentally spilled thereon will be described with reference to FIGS. 1 and 2. When the user of the printer 1 accidentally spills water or another liquid on top of the main casing 2, the liquid lands on the top surface of the top wall 43. If this occurs, some of the liquid may enter the gap C1 formed between the first-tray body 85 of the first tray 64 and the front peripheral edge of the opening 66 formed in the top cover 63.

As shown in FIG. 2, a liquid L1 on the right portion of the gap C1 passes through the gap C1 between the front edge of the first-tray body 85 and the front protruding wall 71A of the top cover 63 and falls onto the top surface of the sloped part 81 constituting the right guiding part 75, as shown in FIGS. 4A and 4B. As shown in FIG. 7B, this liquid L1 then flows downward to the right along the slope of the sloped part 81, passing through the notched groove 72 (also see FIGS. 4A and 4B). Upon reaching the right edge of the sloped part 81, the liquid L1 flows down along the protruding part 82 at the right edge of the sloped part 81, dropping onto the front portion of the bottom plate 91 constituting the first-tray guiding part 87. As shown in FIG. 5C, the liquid L1 continues to flow downward toward the rear along the slope of the bottom plate 91, passing through the opening 94 and flowing onto the top surface of the first-tray body 85 in the discharge tray 13, as shown in FIGS. 2 and 5C.

Further, a liquid L2 entering the left portion of the gap C1 passes through the gap C1 between the front edge of the first-tray body 85 and the front protruding wall 71A of the top cover 63 and flows onto the top surface of the first sloped part 78 constituting the left guiding part 76, as shown in FIGS. 4A and 4B. At this time, the liquid L2 flows downward toward the left along the slope of the first sloped part 78, as shown in FIG. 7B. Here, the front protruding wall 71A and left protruding wall 71B change the direction of flow from a direction diagonally downward and leftward to a direction diagonally downward and rearward, as illustrated in FIG. 4B, and the liquid L2 flows onto the top surface of the second sloped part 79. At this time, the liquid L2 continues to flow downward toward the rear along the slope of the second sloped part 79. Upon reaching the rear edge of the second sloped part 79, the liquid L2 flows down into the left end of the passage 134 formed in the duct unit 115. The liquid L2 subsequently passes through the leftmost through-hole 121A formed in the first coupling part 119 (see FIG. 9).

Further, a liquid L3 shown in FIG. 2 that enters the approximate left-right center region of the gap C1 passes through the gap C1 between the front edge of the first-tray body 85 and the front protruding wall 71A of the top cover 63, flowing down onto the top surface of the intermediate part 77 shown in FIGS. 4A and 4B. Owing to the structure of the intermediate part 77, front protruding wall 71A, and flange part 74, the liquid L3 is temporarily accumulated in the intermediate part 77 and, after the level of accumulated liquid L3 rises, begins to flow out from the left and right ends of the intermediate part 77 into the right guiding part 75 and left guiding part 76.

Thus, the opening 66 having the above construction guides liquid flowing into the gap C1 so as to discharge the liquid therefrom.

(2) Liquid Guided by the Liquid-Receiving Unit

As shown in FIGS. 1 and 2, liquid spilled onto the top surface of the top wall 43 may also penetrate the gap C2 formed between the first-tray body 85 of the first tray 64 and the sloped wall 111 of the second tray 65.

As shown in FIG. 1, a liquid L4 penetrating the gap C2 enters the main casing 2 through the gap C2 and flows down along the second-tray guiding part 108. Upon reaching the bottom of the second-tray guiding part 108, the liquid L4 drops off the bottom edge of the second-tray guiding part 108 onto the top surface of the receiving wall 125. In other words, the receiving wall 125 receives the liquid that enters the main casing 2 through the gap C2. The liquid flowing onto the receiving wall 125 then flows downward toward the front along the slope of the first portion 126 constituting the receiving wall 125.

After the liquid L4 flows down the first portion 126 of the receiving wall 125 onto the top surface of the second portion 127 shown in FIG. 10, the liquid L4 begins to flow downward to the left along the top surface of the second portion 127 and the rear surface of the first guiding wall 128. Once the liquid L4 arrives at the left end of the liquid-receiving member 116, the restricting wall 131 and second guiding wall 129 change the direction of flow from a direction diagonally downward and leftward to a forward direction and discharge the liquid L4 through the liquid outlet 133. The liquid L4 discharged through the liquid outlet 133 enters the passage 134 formed in the duct unit 115 and flows down through the passage 134, as shown in FIG. 1. When the liquid L4 reaches the first coupling part 119, the liquid L4 passes through the leftmost through-hole 121A shown in FIG. 9.

(3) Liquid Flowing Down toward the Paper Tray

Liquid that passes through the leftmost through-hole 121A (i.e., the liquid L2 and L4) continues to flow downward toward the first liquid passage 145 formed in the first conveying member 143. The liquid passes through the first liquid passage 145 and then passes through the second liquid passage 146 formed in the second conveying member 144 to be collected in the paper tray 12.

7. Operational and Technical Advantages (1) As shown in FIG. 1, the liquid-receiving member 116 that receives liquid entering the main casing 2 includes the receiving wall 125. The receiving wall 125 is disposed beneath the gap C2 formed between the adjacent portions of the first tray 64 and second tray 65. Accordingly, the liquid L4 that enters the main casing 2 through the gap C2 is received on the receiving wall 125 of the liquid-receiving member 116. Since the receiving wall 125 slopes downward from the first frame 45 side toward the second frame 55 side, as shown in FIG. 10, the liquid L4 received on the receiving wall 125 is guided from the side nearest the first frame 45 that supports the control board 141 toward the second frame 55 side, i.e., in a direction away from the control board 141.

Thus, this configuration can prevent the control board 141 from becoming wet when liquid is spilled onto the top wall 43 of the main casing 2.

(2) As shown in FIG. 1, the discharge tray 13 is formed by the first tray 64 and second tray 65 and, hence, is disposed on the top surface of the main casing 2. Therefore, the user can easily access the sheets P that have been discharged by the discharge rollers 32 into the discharge tray 13.

Further, since both the gap C2 and the liquid-receiving member 116 extend in the left-right direction, as illustrated in FIGS. 2 and 10, the liquid-receiving member 116 can reliably receive the liquid L4 that enters the main casing 2 through the gap C2.

(3) As shown in FIG. 1, the second tray 65 possesses the second-tray guiding part 108. The second-tray guiding part 108 guides the liquid L4 that enters the main casing 2 through the gap C2 toward the liquid-receiving member 116. Accordingly, the liquid-receiving member 116 can reliably receive the liquid L4 that enters the main casing 2 through the gap C2.

(4) As shown in FIG. 1, the receiving wall 125 is positioned beneath the second-tray guiding part 108 so as to confront the second-tray guiding part 108 vertically, but is separated therefrom. Accordingly, the receiving wall 125 can reliably receive the liquid L4 that flows down from the second-tray guiding part 108.

The liquid-receiving member 116 has the receiving wall 125, first guiding wall 128, and second guiding wall 129 and is arranged in a concave shape that opens toward the second-tray guiding part 108 when viewed in the left-right direction. This construction can reliably guide the liquid L4 received on the receiving wall 125 from the first frame 45 side toward the second frame 55 side.

(5) As shown in FIG. 1, the receiving wall 125 has the first portion 126 that slopes downward from the second guiding wall 129 toward the first guiding wall 128 side. Accordingly, the liquid L4 received on the receiving wall 125 flows down along the slope of the first portion 126 toward the second portion 127 on the first guiding wall 128 side. As shown in FIG. 10, the liquid L4 flows along the second portion 127 and first guiding wall 128 toward the second frame 55 side, i.e., leftward. Thus, the liquid-receiving member 116 can reliably guide the liquid L4 toward the second frame 55.

(6) As shown in FIG. 10, the liquid outlet 133 is defined by the left end of the first guiding wall 128, the restricting wall 131, and the portion of the receiving wall 125 positioned between these parts. In other words, the liquid outlet 133 is arranged on the left end of the liquid-receiving member 116, i.e., at a position farthest away from the control board 141.

In this way, the liquid L4 in the liquid-receiving member 116 is first guided to the location in the liquid-receiving member 116 farthest from the control board 141, and then discharged from the liquid-receiving member 116 through the liquid outlet 133. Accordingly, this configuration reliably prevents the control board 141 from being splashed by liquid discharged from the liquid-receiving member 116.

(7) As shown in FIGS. 8A and 8B, the extending wall 132 extends continuously forward from the left edge of the first guiding wall 128 to extend away from the second guiding wall 129. In other words, the extending wall 132 extends from the right peripheral edge of the liquid outlet 133 in the direction that liquid is discharged. Accordingly, the extending wall 132 can suppress liquid from flowing rightward, i.e., back toward the control board 141 side, when the liquid is being discharged from the liquid outlet 133. This construction can even more reliably prevent the control board 141 from becoming wet by liquid discharged from the liquid-receiving member 116.

(8) As shown in FIG. 1, the liquid-receiving unit 114 is provided with the duct unit 115. The duct unit 115 enables air within the main casing 2 to be exhausted from the main casing 2. Therefore, heat can be efficiently dissipated from the printer 1.

Further, the liquid-receiving unit 114 is integrally provided with the duct unit 115 and liquid-receiving member 116. This construction requires less parts than if the duct unit 115 and liquid-receiving member 116 were separate members.

(9) As shown in FIG. 1, the duct unit 115 is disposed between the process cartridge 15 and fixing unit 17 in the front-rear direction. This arrangement can efficiently cool both the process cartridge 15 and fixing unit 17.

Further, since the duct unit 115 has the passage 134 for conducting liquid that has been discharged from the liquid outlet 133, the liquid discharged from the liquid outlet 133 flows down through the passage 134 of the duct unit 115 between the process cartridge 15 and fixing unit 17. Hence, the liquid discharged from the liquid outlet 133 can be prevented from contacting the process cartridge 15 and fixing unit 17 and, hence, from causing the process cartridge 15 and fixing unit 17 to malfunction.

(10) As shown in FIG. 2, both the first tray 64 and second tray 65 are exposed above through the opening 66. Accordingly, when liquid is spilled on top of the printer 1, the liquid reaches the first tray 64 and second tray 65 through the opening 66 formed in the top cover 63. Consequently, the liquid passes through the gap C1 and is received by the liquid-receiving member 116, which guides the liquid away from the control board 141, as illustrated in FIG. 10. Hence, when liquid is spilled on the printer 1, the liquid-receiving member 116 can reliably receive the liquid entering the main casing 2.

(11) As shown in FIGS. 4A and 4B, the cover-guiding part 67 guides liquid that enters through the gap C1 formed between adjacent portions of the first tray 64 and the peripheral edge of the opening 66 so as to discharge the liquid from the gap C1. Thus, this construction can prevent liquid from entering the main casing 2 through the gap C1.

(12) As shown in FIGS. 2, 4A, and 4B, the right guiding part 75 positioned relatively near the control board 141 guides the liquid L1 entering the gap C1 onto the first tray 64. The liquid guided onto the first tray 64 then enters the main casing 2 through the gap C2. As shown in FIG. 10, liquid entering the main casing 2 through the gap C2 is first guided away from the control board 141 by the liquid-receiving member 116 and then discharged into the passage 134 of the duct unit 115 through the liquid outlet 133.

On the other hand, the left guiding part 76 positioned relatively far from the control board 141 guides the liquid L2 entering the gap C1 toward the passage 134 formed in the duct unit 115, as illustrated in FIG. 4B. In other words, the right guiding part 75 and left guiding part 76 both guide liquid to be discharged into the passage 134 of the duct unit 115 at a position away from the control board 141. This arrangement reliably prevents the control board 141 from becoming wet by the liquid that enters through the gap C1.

(13) As shown in FIG. 7B, the right guiding part 75 (sloped part 81) guides the liquid L1 entering through the gap C1 toward the right, while the left guiding part 76 (first sloped part 78) guides the liquid L2 entering through the gap C1 toward the left. Hence, the structure of the cover-guiding part 67 can more efficiently guide (discharge) the liquid that enters the gap C1 than a structure that guides liquid in only one of the left and right directions.

(14) As shown in FIG. 4B, the cover-guiding part 67 includes the intermediate part 77, which is recessed downward. Accordingly, the intermediate part 77 can collect or accumulate liquid when the amount of liquid entering the gap C1 increases. Hence, the cover-guiding part 67 can reliably receive the liquid entering the gap C1 when the amount of liquid increases. This configuration can thus suppress liquid from entering the main casing 2 through the gap C1.

(15) As shown in FIGS. 4A and 4B, the top cover 63 is provided with the cover-guiding part 67. Accordingly, even if liquid spilled on top of the top cover 63 enters the gap C1 between the peripheral edge of the opening 66 formed in the top cover 63 and the first tray 64, as shown in FIG. 2, the cover-guiding part 67 can guide this liquid along the peripheral edge of the opening 66 and away from the gap C1.

Hence, the cover-guiding part 67 guides liquid that enters the gap C1 in left and right directions and to prescribed positions. This construction prevents any liquid that penetrates the gap C1 from flowing onto the image-forming unit 4 disposed beneath the top cover 63, as illustrated in FIG. 1. Thus, even if liquid is spilled on the top cover 63, the structure of the invention prevents the image-forming unit 4 and the like from becoming wet.

(16) The cover-guiding part 67 includes the guiding-part body 73 configured of the right guiding part 75 and left guiding part 76. As shown in FIG. 7B, the right guiding part 75 has the sloped part 81 and the left guiding part 76 has the first sloped part 78. The sloped part 81 and first sloped part 78 are sloped such that their outer left-right ends are lower than their inner left-right ends. Accordingly, liquid entering the gap C1 is guided along the sloped part 81 and first sloped part 78 to flow from the inside toward the outside in the left-right direction.

In other words, the cover-guiding part 67 can reliably guide liquid entering the gap C1 to prescribed positions. This structure reliably prevents liquid that enters the gap C1 from reaching the image-forming unit 4.

(17) As shown in FIG. 7B, the protruding part 82 protrudes downward from the right edge of the sloped part 81 constituting the right guiding part 75. Accordingly, after the liquid L1 entering the gap C1 is guided along the sloped surface of the sloped part 81 to the right edge thereof, the liquid L1 flows down from the sloped part 81 along the protruding part 82. Thus, the protruding part 82 can reliably guide liquid in the right guiding part 75 to a prescribed location.

(18) As shown in FIG. 7B, the first-tray guiding part 87 is disposed beneath the right end of the right guiding part 75 in a position that overlaps the right edge of the sloped part 81 in the vertical direction. Accordingly, after liquid that enters the gap C1 is guided along the sloped part 81 of the right guiding part 75 to the right edge of the sloped part 81, the liquid flows down into the first-tray guiding part 87 of the first tray 64. Hence, this configuration reliably prevents liquid that flows off the cover-guiding part 67 from contacting the image-forming unit 4.

(19) As shown in FIG. 7B, the right plate 101 of the enclosing plate 92 of the first-tray guiding part 87 is disposed to the right of and separated from the sloped part 81 and extends to a position above the sloped part 81. Accordingly, when liquid flows off the sloped part 81 into the first-tray guiding part 87, the right plate 101 can prevent this liquid from moving rightward. Accordingly, this construction reliably transfers liquid from the right guiding part 75 to the first-tray guiding part 87.

(20) As shown in FIG. 7B, the first-tray guiding part 87 has the bottom plate 91. Accordingly, liquid transferred from the right guiding part 75 to the first-tray guiding part 87 can be reliably received by the first-tray guiding part 87.

(21) As shown in FIGS. 5A through 5C, the first-tray guiding part 87 has the enclosing plate 92. Accordingly, liquid received on the bottom plate 91 is retained in the enclosing plate 92. Thus, this construction can suppress an intended flow of liquid off the first-tray guiding part 87.

(22) As shown in FIG. 5C, the bottom plate 91 is formed continuously with the top surface of the first-tray body 85. Hence, liquid received in the first-tray guiding part 87 first flows along the bottom plate 91, and then is discharged from the bottom plate 91 onto the top surface of the first tray 64. As a result, liquid penetrating the gap C1 can be prevented from entering the main casing 2.

(23) As shown in FIGS. 4A and 4B, the cover-guiding part 67 is provided on the top cover 63. Hence, this configuration facilitates formation of the cover-guiding part 67.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a casing;

an image-forming unit disposed within the casing and configured to form an image on a recording medium;

a circuit board configured to control operations of the image-forming unit; and a receiving unit configured to receive liquid entering into the casing, wherein the casing includes:

a wall portion constituting a top surface of the casing and positioned upward of the image-forming unit in a vertical direction, the wall portion including a first member and a second member positioned adjacent to each other to provide a first gap therebetween;

a first frame supporting the circuit board; and a second frame disposed to oppose and be spaced away from the first frame in an orthogonal direction orthogonal to the vertical direction, the image-forming unit being disposed between the first frame and the second frame in the orthogonal direction, wherein the receiving unit is positioned below the first gap, the receiving unit including a receiving wall configured to receive the liquid entering into the casing through the first gap, the receiving wall being slanted downward toward the second frame.

2. The image forming apparatus as claimed in claim 1, further comprising:

a discharge member configured to discharge the recording medium having the image formed thereon outside the casing in a discharge direction; and a support tray configured to receive the recording medium discharged by the discharge member, the first member and the second member constituting the support tray to provide the first gap extending in the orthogonal direction, the first member being positioned downstream of the second member in the discharge direction.

3. The image forming apparatus as claimed in claim 2, wherein one of the first member and the second member includes a guide part configured to guide the liquid entering into the casing through the first gap toward the receiving unit.

4. The image forming apparatus as claimed in claim 3, wherein the receiving wall is positioned below the guide part to oppose the guide part in the vertical direction, and wherein the receiving unit further includes a first wall and a second wall respectively extending upward from the receiving wall to oppose each other in the discharge direction.

5. The image forming apparatus as claimed in claim 4, wherein the receiving wall comprises a first portion and a second portion, the first portion extending from the second wall toward the first wall and sloping downward toward the first wall, the second portion extending from the first portion toward the first wall in the discharge direction.

6. The image forming apparatus as claimed in claim 4, wherein the receiving wall, the first wall and the second wall also extend in the orthogonal direction, the receiving wall having one receiving end near the second frame in the orthogonal direction, the first wall having one first end near the second frame in the orthogonal direction and the second wall having one second end near the second frame in the orthogonal direction, wherein the receiving unit further includes a third wall extending upward from the one receiving end of the receiving wall, the one first end of the first wall opposing the third wall with a space defined therebetween in the orthogonal direction, the one second end of the second wall being connected to the third wall, and wherein the one first end of the first wall, the third wall and a portion of the receiving wall interposed between the one first end of the first wall and the third wall define a discharge port configured to discharge the liquid received by the receiving unit.

7. The image forming apparatus as claimed in claim 6, wherein the receiving unit further includes a fourth wall extending from the one first end of the first wall in a direction away from the second wall.

8. The image forming apparatus as claimed in claim 6, further comprising a duct configured to exhaust air within the casing toward outside thereof, the duct being integrally formed with the receiving unit.

9. The image forming apparatus as claimed in claim 8, wherein the image-forming unit comprises:

a process unit disposed within the casing and configured to form an developer image on the recording medium; and a fixing unit positioned to be spaced away from the process unit and configured to thermally fix the developer image to the recording medium, and wherein the duct is positioned between the process unit and the fixing unit and is formed with a passage for permitting the liquid discharged from the discharge port to pass therethrough.

10. The image forming apparatus as claimed in claim 1, wherein the wall portion further comprises a cover constituting a top surface of the wall portion, the cover being formed with an opening to penetrate therethrough in the vertical direction, the first member and the second member being disposed within the opening when viewed from above.

11. The image forming apparatus as claimed in claim 10, wherein the opening is defined by a peripheral wall, the first member being positioned adjacent to the peripheral wall to provide a second gap therebetween, and wherein the cover includes a cover-guide part configured to guide the liquid entering into the casing through the second gap to discharge from the second gap.

12. The image forming apparatus as claimed in claim 11, wherein the second gap extends in the orthogonal direction, and wherein the cover-guide part comprises a first guide part positioned near the first frame and a second guide part positioned near the second frame in the orthogonal direction, the first guide part being configured to guide the liquid toward the first frame and the second guide part being configured to guide the liquid toward the second frame.

13. The image forming apparatus as claimed in claim 12, wherein the cover-guide part further comprises a recessed portion positioned between the first guide part and the second guide part in the orthogonal direction, the recessed portion being recessed downward for receiving the liquid entering into the casing through the second gap.

14. The image forming apparatus as claimed in claim 11, wherein the cover-guide part includes a sloped part having an inner end and an outer end in the orthogonal direction, the sloped part sloping relative to the orthogonal direction such that the outer end is positioned downward than the inner end.

15. The image forming apparatus as claimed in claim 14, wherein the cover-guide part extends in the orthogonal direction and has an outer edge in the orthogonal direction, the outer edge being formed with a protruding part protruding downward.

16. The image forming apparatus as claimed in claim 14, wherein the cover-guide part extends in the orthogonal direction and has an outer end in the orthogonal direction, and wherein one of the first member and the second member includes a receiving part positioned below the outer end to overlap with the outer end in the vertical direction, the receiving part being configured to receive the liquid guided into the cover-guide part.

17. The image forming apparatus as claimed in claim 16, wherein the receiving part includes a wall part positioned outward of the outer end of the cover-guide part in the orthogonal direction, the wall part extending upward to provide an upper edge positioned higher than the outer end of the cover-guide part in the vertical direction.

18. The image forming apparatus as claimed in claim 16, wherein the receiving part includes a bottom part constituting a bottom wall of the receiving part.

19. The image forming apparatus as claimed in claim 18, wherein the receiving part further includes an enclosing part protruding upward from the bottom part and surrounding the bottom part to have a general U-shape when viewed from above.

20. The image forming apparatus as claimed in claim 18, wherein the one of the first member and the second member provided with the receiving part includes an upper surface, the bottom part being connected to the upper surface.

* * * * *